US007740563B2

(12) United States Patent
Dalebout et al.

(10) Patent No.: US 7,740,563 B2
(45) Date of Patent: Jun. 22, 2010

(54) ELLIPTICAL EXERCISE MACHINE WITH INTEGRATED ANAEROBIC EXERCISE SYSTEM

(75) Inventors: William T. Dalebout, North Logan, UT (US); Michael L. Olson, Logan, UT (US); Darren C. Ashby, Richmond, UT (US); Darren Zaugg, Providence, UT (US)

(73) Assignee: Icon IP, Inc., Logan, UT (US)

( * ) Notice: Subject to any disclaimer, the term of this patent is extended or adjusted under 35 U.S.C. 154(b) by 915 days.

(21) Appl. No.: 10/916,684

(22) Filed: Aug. 11, 2004

(65) Prior Publication Data

US 2006/0035755 A1 Feb. 16, 2006

(51) Int. Cl.
*A63B 22/04* (2006.01)
*A63B 22/12* (2006.01)

(52) U.S. Cl. ..... 482/52; 482/62

(58) Field of Classification Search ..... 482/51–54, 482/57, 62, 70, 71, 121, 123, 129, 130, 142; *A63B 22/04, A63B 12/00*
See application file for complete search history.

(56) References Cited

U.S. PATENT DOCUMENTS

| | | | | |
|---|---|---|---|---|
| 3,316,898 | A | 5/1967 | Brown | |
| 3,501,140 | A * | 3/1970 | Eichorn | 482/130 |
| 3,756,595 | A | 9/1973 | Hague | |
| 3,824,994 | A | 7/1974 | Soderberg, Sr. | |
| 3,941,377 | A | 3/1976 | Lie | |
| 4,140,312 | A * | 2/1979 | Buchmann | 482/62 |
| 4,300,760 | A | 11/1981 | Bobroff | |
| 4,354,675 | A | 10/1982 | Barclay | |
| 4,625,962 | A | 12/1986 | Street | |
| 4,679,787 | A * | 7/1987 | Guilbault | 482/54 |
| 4,708,338 | A | 11/1987 | Potts | |
| 4,720,093 | A | 1/1988 | Del Mar | |
| 4,938,474 | A | 7/1990 | Sweeney et al. | |
| 5,013,031 | A | 5/1991 | Bull | |
| 5,039,088 | A | 8/1991 | Shifferaw | |
| 5,078,389 | A | 1/1992 | Chen | |

(Continued)

FOREIGN PATENT DOCUMENTS

| | | |
|---|---|---|
| CN | 2169450 | 6/1994 |

(Continued)

OTHER PUBLICATIONS

Horizon Series E30 E20 [online] [ retrieved on Jul. 27, 2004] Retrieved from the Internet: URL: http://www.horizonfitness.com/horizon-series/ellipticals/e20.php.

(Continued)

*Primary Examiner*—Loan H Thanh
*Assistant Examiner*—Oren Ginsberg
(74) *Attorney, Agent, or Firm*—Workman Nydegger

(57) ABSTRACT

A combined anaerobic and aerobic exercise system comprises a multi-part frame, for example a telescoping frame, or a pivoting frame. The aerobic system may include an elliptical exercise device, while the anaerobic system may include a cable-based system wherein resistance is adjustable. An electronic console system at the exercise system allows a user to view progress in both anaerobic and aerobic workouts, and to send input signals that adjust anaerobic and aerobic resistance mechanisms.

29 Claims, 14 Drawing Sheets

U.S. PATENT DOCUMENTS

| | | | | | |
|---|---|---|---|---|---|
| 5,135,447 | A | | 8/1992 | Robards, Jr. et al. | |
| 5,195,935 | A | | 3/1993 | Fencel | |
| 5,242,343 | A | | 9/1993 | Miller | |
| 5,279,529 | A | | 1/1994 | Eschenbach | |
| 5,279,531 | A | | 1/1994 | Jen-Huey | |
| D344,112 | S | | 2/1994 | Smith | |
| 5,290,211 | A | | 3/1994 | Stearns | |
| 5,299,993 | A | | 4/1994 | Habing | |
| 5,322,491 | A | | 6/1994 | Wanzer et al. | |
| 5,336,141 | A | | 8/1994 | Vittone | |
| 5,352,169 | A | | 10/1994 | Eschenbach | |
| 5,383,829 | A | | 1/1995 | Miller | |
| D356,128 | S | | 3/1995 | Smith et al. | |
| 5,415,607 | A | | 5/1995 | Carpenter | |
| 5,419,751 | A | | 5/1995 | Byrd et al. | 482/138 |
| 5,423,729 | A | | 6/1995 | Eschenbach | |
| 5,435,799 | A | | 7/1995 | Lundin | 482/8 |
| 5,435,801 | A | | 7/1995 | Hung | 482/130 |
| D367,689 | S | | 3/1996 | Wilkinson et al. | |
| 5,499,956 | A | | 3/1996 | Habing et al. | |
| 5,518,473 | A | | 5/1996 | Miller | |
| 5,527,245 | A | * | 6/1996 | Dalebout et al. | 482/54 |
| 5,527,246 | A | | 6/1996 | Rodgers | |
| 5,529,554 | A | | 6/1996 | Eschenbach | |
| 5,529,555 | A | | 6/1996 | Rodgers, Jr. | |
| 5,540,637 | A | | 7/1996 | Rodgers, Jr. | |
| 5,549,526 | A | | 8/1996 | Rodgers, Jr. | |
| 5,562,574 | A | | 10/1996 | Miller | |
| 5,573,480 | A | | 11/1996 | Rodgers, Jr. | |
| 5,577,985 | A | | 11/1996 | Miller | |
| 5,591,107 | A | | 1/1997 | Rodgers | |
| 5,593,371 | A | | 1/1997 | Rodgers, Jr. | |
| 5,593,372 | A | | 1/1997 | Rodgers, Jr. | |
| 5,595,553 | A | | 1/1997 | Rodgers, Jr. | |
| 5,595,556 | A | | 1/1997 | Dalebout et al. | |
| 5,611,756 | A | | 3/1997 | Miller | |
| 5,611,757 | A | | 3/1997 | Rodgers | |
| 5,611,758 | A | | 3/1997 | Rodgers | |
| 5,616,103 | A | | 4/1997 | Lee | |
| 5,626,542 | A | | 5/1997 | Dalebout et al. | |
| 5,637,058 | A | | 6/1997 | Rodgers | |
| D380,509 | S | | 7/1997 | Wilkinson et al. | |
| 5,653,662 | A | | 8/1997 | Rodgers, Jr. | |
| D384,118 | S | | 9/1997 | Deblauw | |
| 5,672,140 | A | | 9/1997 | Watterson et al. | |
| 5,683,333 | A | | 11/1997 | Rodgers, Jr. | |
| 5,685,804 | A | | 11/1997 | Whan-Tong et al. | |
| 5,690,589 | A | | 11/1997 | Rodgers, Jr. | |
| 5,692,994 | A | * | 12/1997 | Eschenbach | 482/57 |
| 5,695,434 | A | | 12/1997 | Dalebout et al. | |
| 5,695,435 | A | | 12/1997 | Dalebout et al. | |
| 5,707,320 | A | | 1/1998 | Yu | |
| 5,707,321 | A | | 1/1998 | Maresh | |
| 5,722,922 | A | | 3/1998 | Watterson et al. | 482/136 |
| 5,738,614 | A | | 4/1998 | Rodgers, Jr. | |
| 5,743,834 | A | | 4/1998 | Rodgers, Jr. | |
| 5,755,642 | A | | 5/1998 | Miller | |
| 5,766,113 | A | | 6/1998 | Rodgers, Jr. | |
| 5,772,558 | A | | 6/1998 | Rodgers, Jr. | |
| 5,779,599 | A | | 7/1998 | Chen | |
| 5,782,722 | A | | 7/1998 | Sands et al. | |
| 5,788,609 | A | | 8/1998 | Miller | |
| 5,788,610 | A | | 8/1998 | Eschenbach | |
| 5,792,026 | A | | 8/1998 | Maresh et al. | |
| 5,795,268 | A | | 8/1998 | Husted | |
| 5,813,949 | A | | 9/1998 | Rodgers, Jr. | |
| 5,823,917 | A | | 10/1998 | Chen | |
| 5,830,113 | A | * | 11/1998 | Coody et al. | 482/54 |
| 5,830,114 | A | | 11/1998 | Halfen et al. | |
| 5,833,582 | A | * | 11/1998 | Chen | 482/57 |
| 5,836,854 | A | | 11/1998 | Kuo | 482/52 |
| D403,033 | S | | 12/1998 | Husted et al. | |
| 5,846,166 | A | | 12/1998 | Kuo | |
| 5,857,941 | A | | 1/1999 | Maresh et al. | |
| 5,860,893 | A | | 1/1999 | Watterson et al. | |
| 5,860,895 | A | | 1/1999 | Lee | |
| 5,873,608 | A | | 2/1999 | Tharp et al. | |
| 5,897,460 | A | | 4/1999 | McBride et al. | |
| 5,899,834 | A | | 5/1999 | Dalebout et al. | |
| 5,904,637 | A | | 5/1999 | Kuo | |
| 5,911,649 | A | | 6/1999 | Miller | |
| 5,913,751 | A | | 6/1999 | Eschenbach | |
| 5,916,064 | A | | 6/1999 | Eschenbach | |
| 5,916,065 | A | * | 6/1999 | McBride et al. | 482/57 |
| 5,919,118 | A | | 7/1999 | Stearns et al. | |
| 5,924,962 | A | | 7/1999 | Rodgers, Jr. | |
| D413,366 | S | | 8/1999 | Husted et al. | |
| 5,938,567 | A | | 8/1999 | Rodgers, Jr. | |
| 5,938,570 | A | * | 8/1999 | Maresh | 482/57 |
| 5,944,638 | A | | 8/1999 | Maresh et al. | |
| 5,947,872 | A | | 9/1999 | Ryan et al. | |
| 5,951,449 | A | * | 9/1999 | Oppriecht | 482/113 |
| 5,957,814 | A | | 9/1999 | Eschenbach | |
| 5,961,423 | A | | 10/1999 | Sellers | 482/57 |
| 5,997,445 | A | | 12/1999 | Maresh et al. | |
| 6,001,046 | A | | 12/1999 | Chang | |
| 6,004,244 | A | | 12/1999 | Simonson | |
| 6,007,462 | A | | 12/1999 | Chen | |
| 6,019,710 | A | | 2/2000 | Dalebout | |
| 6,022,296 | A | * | 2/2000 | Yu | 482/52 |
| 6,024,676 | A | | 2/2000 | Eschenbach | |
| 6,027,431 | A | | 2/2000 | Stearns et al. | |
| 6,030,319 | A | | 2/2000 | Wu | |
| 6,030,320 | A | * | 2/2000 | Stearns et al. | 482/57 |
| 6,042,512 | A | | 3/2000 | Eschenbach | |
| 6,045,487 | A | | 4/2000 | Miller | |
| 6,099,439 | A | | 8/2000 | Ryan et al. | |
| 6,106,439 | A | | 8/2000 | Boland | 482/51 |
| 6,123,649 | A | * | 9/2000 | Lee et al. | 482/54 |
| 6,123,650 | A | | 9/2000 | Birrell | |
| 6,135,927 | A | | 10/2000 | Lo | 482/57 |
| 6,146,313 | A | | 11/2000 | Whan-Tong et al. | |
| 6,149,551 | A | | 11/2000 | Pyles et al. | |
| 6,165,107 | A | | 12/2000 | Birrell | |
| 6,171,217 | B1 | | 1/2001 | Cutler | |
| 6,176,814 | B1 | | 1/2001 | Ryan et al. | |
| 6,190,289 | B1 | | 2/2001 | Pyles et al. | 482/52 |
| 6,196,948 | B1 | | 3/2001 | Stearns et al. | |
| 6,206,804 | B1 | | 3/2001 | Maresh | |
| 6,210,305 | B1 | * | 4/2001 | Eschenbach | 482/52 |
| 6,217,486 | B1 | | 4/2001 | Rosenow | |
| 6,248,044 | B1 | | 6/2001 | Stearns et al. | |
| 6,261,209 | B1 | | 7/2001 | Coody | |
| 6,277,055 | B1 | | 8/2001 | Birrell et al. | |
| 6,315,702 | B1 | * | 11/2001 | Ikonomopoulos | 482/138 |
| 6,338,698 | B1 | | 1/2002 | Stearns et al. | |
| 6,361,476 | B1 | | 3/2002 | Eschenbach | |
| 6,368,252 | B1 | | 4/2002 | Stearns | |
| 6,390,953 | B1 | | 5/2002 | Maresh et al. | |
| 6,398,695 | B2 | | 6/2002 | Miller | |
| 6,409,632 | B1 | | 6/2002 | Eschenbach | |
| 6,422,976 | B1 | | 7/2002 | Eschenbach | |
| 6,422,977 | B1 | | 7/2002 | Eschenbach | |
| 6,436,007 | B1 | | 8/2002 | Eschenbach | |
| 6,440,042 | B2 | | 8/2002 | Eschenbach | |
| 6,482,132 | B2 | | 11/2002 | Eschenbach | |
| 6,500,096 | B1 | | 12/2002 | Farney | |
| 6,544,147 | B1 | | 4/2003 | Wang et al. | |
| 6,551,217 | B2 | | 4/2003 | Kaganovsky | 482/51 |
| 6,582,343 | B2 | | 6/2003 | Lin et al. | |
| 6,612,969 | B2 | | 9/2003 | Eschenbach | |
| 6,645,125 | B1 | | 11/2003 | Stearns et al. | |
| 6,685,607 | B1 | | 2/2004 | Olson | 482/142 |
| 6,730,002 | B2 | | 5/2004 | Hald et al. | |

| | | | | |
|---|---|---|---|---|
| 6,749,540 | B1 | 6/2004 | Pasero et al. | |
| 6,752,744 | B2 | 6/2004 | Arnold et al. | |
| 6,758,790 | B1 | 7/2004 | Ellis | |
| 6,783,481 | B2 | 8/2004 | Stearns et al. | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,949,053 | B1 | 9/2005 | Stearns et al. | |
| 6,949,054 | B1 | 9/2005 | Stearns et al. | |
| 6,979,283 | B2 | 12/2005 | Pan | |
| 7,025,711 | B2 | 4/2006 | Eschenbach | |
| 7,033,305 | B1 | 4/2006 | Stearns et al. | |
| 7,052,440 | B2 | 5/2006 | Pyles et al. | 482/54 |
| 7,060,005 | B2 | 6/2006 | Carlsen et al. | |
| 7,097,592 | B2 | 8/2006 | Wang | |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,278,955 | B2 | 10/2007 | Giannelli et al. | |
| D554,715 | S | 11/2007 | Giannelli et al. | |
| D563,489 | S | 3/2008 | Giannelli et al. | |
| D564,051 | S | 3/2008 | Giannelli et al. | |
| 7,513,855 | B1 * | 4/2009 | Yeh | 482/52 |
| 2002/0086779 | A1 | 7/2002 | Wilkinson | 482/118 |
| 2002/0198084 | A1 | 12/2002 | Stearns et al. | |
| 2003/0045403 | A1 | 3/2003 | Watterson et al. | |
| 2003/0083177 | A1 | 5/2003 | Tung | |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1 | 8/2004 | Ercanbrack et al. | |
| 2004/0198561 | A1 | 10/2004 | Corbalis et al. | |
| 2004/0204294 | A2 * | 10/2004 | Wilkinson et al. | 482/54 |
| 2004/0224825 | A1 | 11/2004 | Giannelli et al. | |
| 2005/0009668 | A1 | 1/2005 | Savettiere et al. | |
| 2005/0026752 | A1 | 2/2005 | Lull et al. | |
| 2005/0101463 | A1 * | 5/2005 | Chen | 482/142 |
| 2005/0130807 | A1 | 6/2005 | Cutler et al. | |
| 2005/0164837 | A1 | 7/2005 | Anderson et al. | |
| 2005/0181912 | A1 | 8/2005 | Eschenbach | |
| 2005/0202939 | A1 | 9/2005 | Lull et al. | |
| 2005/0209059 | A1 * | 9/2005 | Crawford et al. | 482/54 |
| 2006/0019804 | A1 * | 1/2006 | Young | 482/93 |
| 2006/0035754 | A1 | 2/2006 | Giannelli et al. | |
| 2006/0035755 | A1 | 2/2006 | Dalebout | |
| 2006/0040794 | A1 | 2/2006 | Giannelli et al. | |
| 2006/0166791 | A1 | 7/2006 | Liao et al. | |
| 2006/0217236 | A1 | 9/2006 | Watterson et al. | |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0015633 | A1 * | 1/2007 | Gerschefske et al. | 482/52 |
| 2007/0060449 | A1 | 3/2007 | Lo | |
| 2007/0060450 | A1 | 3/2007 | Lo | |
| 2007/0117683 | A1 | 5/2007 | Ercanbrack et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0162823 | A1 | 7/2007 | Lin et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0200314 | A1 | 8/2008 | Dalebout et al. | |

FOREIGN PATENT DOCUMENTS

| | | |
|---|---|---|
| CN | 1315878 | 10/2001 |
| CN | 2516647 | 10/2002 |
| CN | 2696675 | 5/2005 |
| DE | 229712 | 1/1911 |
| FR | 498.150 | 6/1916 |
| WO | WO95/00209 | 1/1995 |
| WO | WO96/08292 | 3/1996 |
| WO | 99/58204 | 11/1999 |
| WO | WO 2006/138601 | 12/2006 |
| WO | WO 2008/103612 | 8/2008 |

OTHER PUBLICATIONS

Horizon Elliptical Series [online] [ retrieved on Jul. 27, 2004] Retrieved from the Internet: URL: http://www.horizonfitness.com/horizon-series/ellipticals/elliptical-spec.php.

Geartrends Fitness 2007 edition, available on information and belief at least as early as Jun. 1, 2007 (6 pages).

CYBEX Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commerical.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pp. 38-41, 66).

Brochure: "Reach Your Summit," 7 pages, available on information and belief at least as early as Nov. 1, 2006.

Operations Manual, 95Le Summit Trainer, LifeFitness, 53 pages, copyright 2006.

Operations Manual, 95Li Summit Trainer, LifeFitness, 39 pages, copyright 2006.
Assembly Instructions, 95Li Summit Trainer, LifeFitness, 10 pages, available on information and belief at least as early as Dec. 18, 2006.
LifeFitness, "Biomechanical Research Presents Benefits of New Summit Trainer," copyright 2006 (2 pages).
Vision Fitness-About Our Ellipticals, www.visionfitness.com, printed Sep. 13, 2005.
Photographs of Octane Fitness Exercise Device, available on information and belief at least as early as Sep. 2006, 8 photographs (3 pages).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006.
User's Manual, Pro-Form XP 520 Razor Elliptical Exerciser, Model No. 831.23744.0, 28 pages, available on information and belief at least as early as Jun. 19, 2007.
Office Action dated Jul. 18, 2008 from U.S. Appl. No. 11/155,328 (9 pages).
Office Action dated May 14, 2008 from U.S. Appl. No. 11/676,643 (14 pages).
Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body! "Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," " Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).
Office Action dated Jan. 7, 2009 from U.S. Appl. No. 11/155,328 (10 pages).
Office Action dated Jan. 23, 2009 from U.S. Appl. No. 11/676,643 (16 pages).
Office Action dated Dec. 20, 2007 from U.S. Appl. No. 11/676,643 (7 pages).
Office Action dated Jan. 22, 2009 from U.S. Appl. No. 11/549,530 (6 pages).
Office Action dated May 26, 2009 from U.S. Appl. No. 11/549,530 (9 pages).
Office Action dated Apr. 3, 2009 from People's Republic of China Patent Application No. 200680021835.9 and English translation thereof (21 pages).
Notice of Allowance dated May 18, 2009 from U.S. Appl. No. 11/155,328 (5 pages).
Comments and Suggestions relating to Apr. 3, 2009 Office Action in People's Repulbic of China Patent Application No. 200680021835.9, Apr. 2009, (3 pages).
Office Action dated Sep. 22, 2009 from U.S. Appl. No. 11/155,328 (10 pages).
Amendment "B" and Response to Final Office Action from U.S. Appl. No. 11/155,328, submitted Apr. 7, 2009, 19 pages.
Amendment "C" and Response to Office Action from U.S. Appl. No. 11/549,530, submitted Aug. 26, 2009, 16 pages.
Amendment "B" and Response to Final Office Action from U.S. Appl. No. 11/676,643, submitted May 11, 2009, 22 pages.
Notice of Allowance and Fees Due dated Oct. 30, 2009 for U.S. Appl. No. 11/676,643 (8 pages).
Pro-Form 850 User's Manual (Model No. PFEL5105.0), available, on information and belief, at least as early as 2005, 24 pages.
Notice of Allowance dated Jul. 10, 2009 from U.S. Appl. No. 11/676,643, 9 pages.
Written Opinion of the International Searching Authority for International Application No. PCT/US08/54120, mailed Nov. 19, 2008, 7 pages.
Written Opinion of the International Searching Authority for International Application No. PCT/US06/23544, mailed Jan. 4, 2007, 4 pages.

* cited by examiner

ELLIPTICAL EXERCISE MACHINE WITH INTEGRATED ANAEROBIC EXERCISE SYSTEM

BACKGROUND OF THE INVENTION

1. The Field of the Invention

The present invention relates to exercise equipment and, more specifically, to exercise devices that provide aerobic and anaerobic activities.

2. The Prior State of the Art

In the field of exercise equipment, a variety of devices have been developed to strengthen and condition muscles commonly used for a variety of activities, including both anaerobic and aerobic activities. Generally speaking, anaerobic activities include activities that require voluntary acting muscles to flex a significant amount during a relatively small number of repetitions, such as while engaging in strength training, e.g., with free weights or an exercise device having a cable-based resistance system. Exercise devices that enable anaerobic exercise include weight systems that provide one or more exercises based on a common resistance mechanism, such as one or more handles or bars coupled to a weight stack or other resistance mechanism via a cable-based system having one or more cables and pulleys.

By contrast, aerobic activities include activities that are designed to dramatically increase heart rate and respiration, often over an extended period of time, such as running, walking, and swimming for several minutes or more. Aerobic conditioning devices that simulate such activities have typically included treadmills, stepping machines, elliptical machines, various types of sliding machines, and so forth.

Recently, elliptical machines have proven especially popular for allowing a user to perform aerobic ambulatory exercises (e.g., walking or running) with moderate to significant intensity, while at the same time providing low impact to the user's joints.

Unfortunately, present exercise systems are generally configured for only one of anaerobic exercises and aerobic exercises, but not for both. This can create a tension for a user since both anaerobic and aerobic exercises can be important components of an exercise regimen. The tension can be heightened since anaerobic and aerobic exercise systems each separately take up a certain amount of space that a user may want to devote to other items, and since each such exercise system can be relatively expensive. Accordingly, a user may be reluctant to purchase both types of individual exercise systems due to any number of cost and space constraints.

As a result, a user may purchase only one type of exercise system, but then forego the benefits of the alternative exercise activities. This is less than ideal for users who desire to implement a complete workout regimen. Alternatively, the user may purchase only one type of exercise system, but then purchase an additional membership to a workout facility to exercise on other apparatuses in different ways. This is less than ideal at least from a convenience standpoint.

Accordingly, an advantage can be realized with exercise apparatuses that can provide the benefits of multiple types of exercises in a convenient and cost-effective manner.

BRIEF SUMMARY OF THE INVENTION

Exemplary embodiments of the present invention include systems, apparatuses, and methods that enable a user to perform anaerobic and/or aerobic activities on a compactable exercise machine. In particular, a user can move an exercise machine into a contracted position, an expanded position, or some combination therebetween, so that the user can access the exercise machine for primarily aerobic exercise, primarily anaerobic exercise, or some combination of both, as appropriate.

An exemplary exercise system may comprise an elliptical exercise device and a strength training device mounted on a telescoping frame. When the telescoping frame is expanded, a user can conveniently engage in elliptical exercises. When the telescoping frame is contracted, a user can conveniently engage in strength training exercises. The telescoping frame also provides convenient storage.

At least a portion of one exercise device, such as certain operable components of the elliptical device, can be mounted on one part of the frame, while at least a portion of the other device, such as certain operable components of the strength training device, can be mounted on another part of the frame. As such, the two portions can be telescopically contracted and expanded, relative to the other.

In addition, one or more sensors and motors can be positioned within the exercise system. The one or more sensors and motors can be configured to transfer (or perform an action on) respective electronic signals sent to and/or from a user. An electronic console can facilitate the signal transfers, and can receive (and send) electronic signals from the one or more sensors or motors. In one implementation, the electronic console can allow a user to view exercise progress in both anaerobic and aerobic workouts, and/or to adjust anaerobic and aerobic resistance mechanisms.

These and other benefits, features, and advantages of the present invention will become more fully apparent from the following description and appended claims, or may be learned by practicing the invention as set forth below.

BRIEF DESCRIPTION OF THE DRAWINGS

A more extensive description of the present invention, including the above-recited features and advantages, will be rendered with reference to the specific embodiments that are illustrated in the appended drawings. Because these drawings depict only exemplary embodiments, the drawings should not be construed as imposing any limitation on the present invention's scope. As such, the present invention will be described and explained with additional specificity and detail through use of the accompanying drawings in which.

DETAILED DESCRIPTION OF THE PREFERRED EMBODIMENTS

The present invention relates generally to systems, apparatuses, and methods that enable a user to perform anaerobic and/or aerobic activities on a compactable exercise machine. In particular, a user can move an exercise machine into a contracted position, an expanded position, or some combination therebetween, so that the user can access the exercise machine for primarily aerobic exercise, primarily anaerobic exercise, or some combination of both, as appropriate.

Figure 1A:
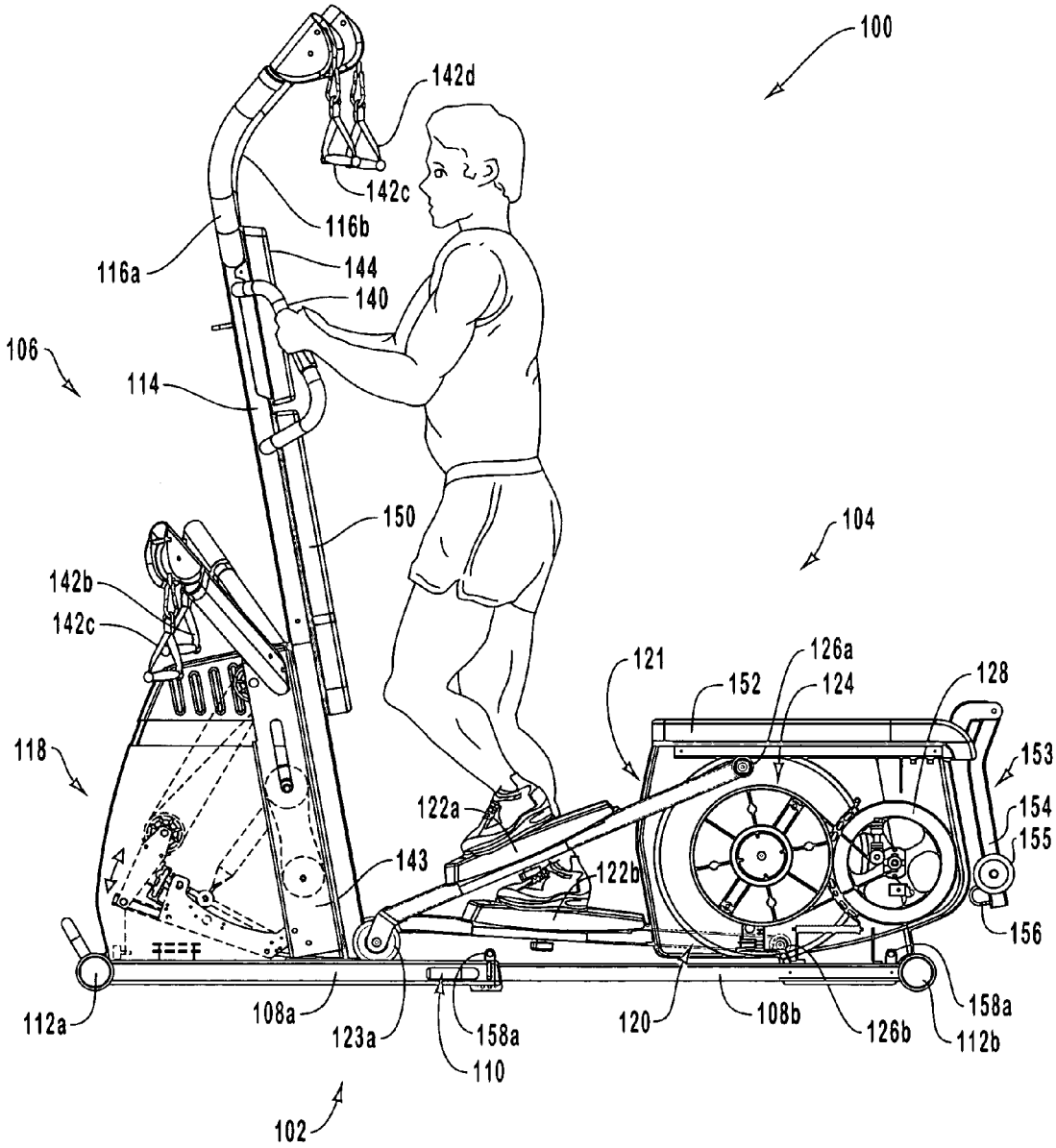
FIG. 1A is a side view of a telescoping exercise system having an aerobic, elliptical device and an anaerobic, strength training device in accordance with an implementation of the present invention.
Figure 1B:
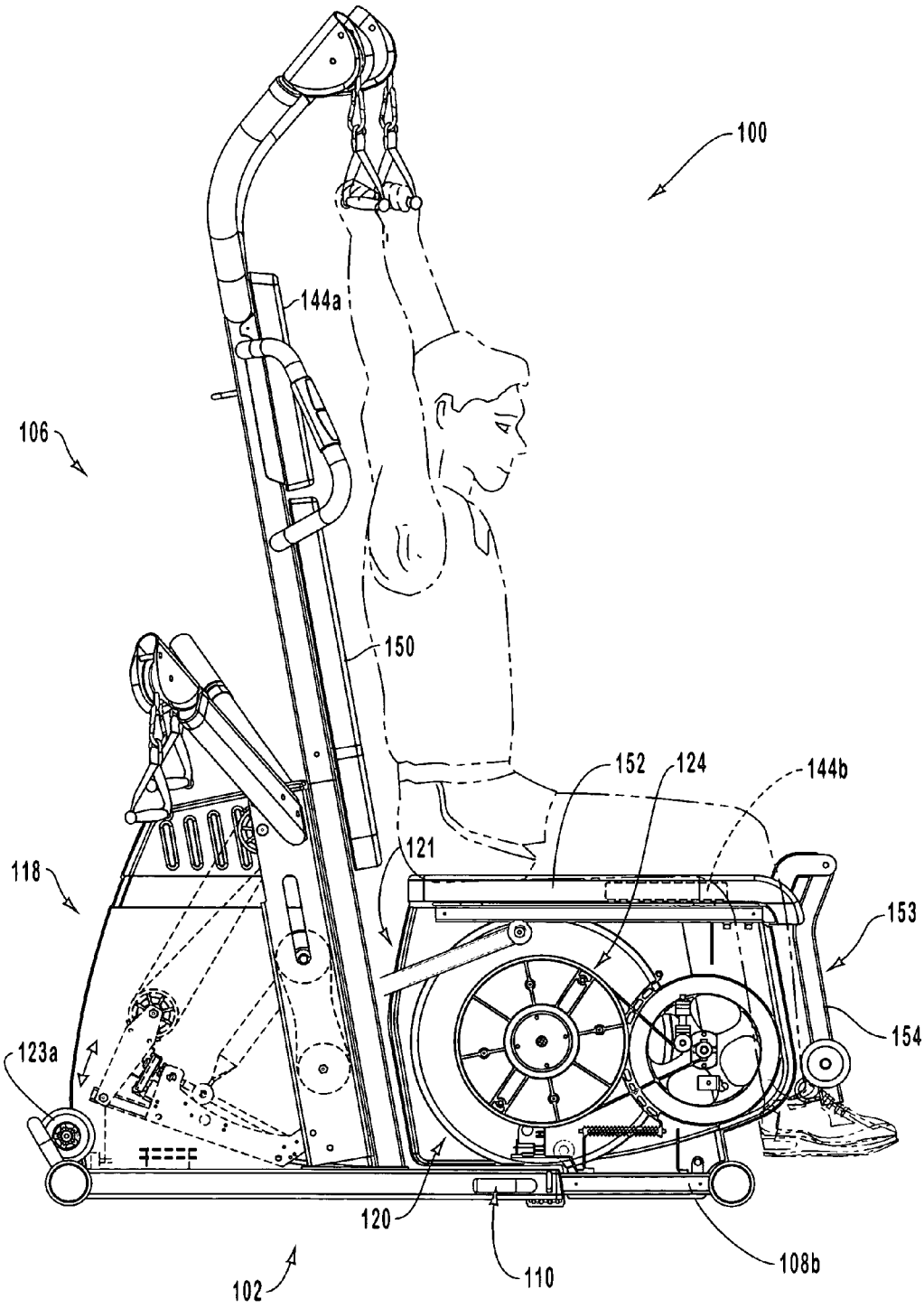
FIG. 1B is a side view of the exercise system depicted in FIG. 1A, wherein the system is contracted.

FIGS. 1A and 1B demonstrate respective extended and contracted views of an aerobic and anaerobic exercise system 100 comprising: (i) a multi-part, telescoping frame 102; (ii) an aerobic, elliptical exercise device 104 coupled to frame 102; and (iii) an anaerobic, strength training device 106 coupled to frame 102. The strength training device 106 shown has a cable-based resistance system, although other systems may also be employed in place of device 106.

A multi-part frame, such as telescoping frame 102, allows exercise system 100 (also referred to sometimes as an exercise "machine") to be (i) extended, enabling convenient aerobic, elliptical exercise; or (ii) compacted, enabling convenient anaerobic, strength training exercise. By enabling convenient elliptical exercise and/or strength training exercise, system 100 is efficient and economic. Also, by being compactable, system 100 can be conveniently stored. Strength training device 106 is compact and lightweight. Frame 102 and devices 104, 106 form a unique exercise apparatus to which a unique electronic console (or unique electronic console system) is coupled. These and other advantages will now be described in additional detail, beginning with a description of the telescoping frame 102 shown in FIGS. 1A-1B.

Telescoping frame 102 comprises a stationary portion 108*a* and a telescoping portion 108*b*. Generally, a "telescoping portion" can be understood as a moving portion that moves inside or away from a "stationary portion". Of course, a manufacturer can also configure telescoping frame 106 such that portion 108*b* is actually the stationary portion, and such that portion 108*a* is actually the telescoping portion. As such, designations of "telescoping" or "stationary" with respect to the frame components are arbitrary, and may be switched by the manufacturer depending on the type of components used in the exercise system 100.

In one implementation, stationary portion 108*a* and telescoping portion 108*b* can be configured such that telescoping portion 108*b* cannot completely separate from the stationary portion 108*a* after full expansion. The stationary portion 108*a* and telescoping portion 108*b* can also be configured such that the telescoping portion 108*b* can be fully contracted with respect to the stationary portion 108*a*, fully expanded from the stationary portion 108*a*, or only partially expanded or contracted. As such, a manufacturer can implement a wide variety of options for configuring a contractible exercise system 100.

Continuing with FIG. 1A, frame 102 further comprises one or more release handles 110 for contracting or expanding frame 102, and one or more rollers 112*a-b*, in order to help position the system 100. Release handle 110 releasably secures frame 102 at different states of contraction or expansion. Rollers 112*a-b* are positioned at an end of one or more of the stationary portion 108*a* and the telescoping portion 108*b*. Rollers 112*a-b* can help a user move the entire exercise system 100 and rollers 112*b* can also help move the telescoping portion 108*b* within and without the stationary portion 108*a*, as needed.

Frame 102 further comprises (i) an upstanding member 114 that is coupled to stationary portion 108*a*; and (ii) pulley attachment beams 116*a-b* which extend from upstanding member 114 at different positions to provide the user with exercise access points to a resistance assembly 118 of the strength training device 106. Additional details relating to the telescopic coupling of frame 110 will be discussed in detail below.

With continued reference to FIGS. 1A-1B, elliptical exercise device 104 will now be discussed in additional detail. Elliptical exercise device 104 comprises (i) a crank 120 movably coupled to telescoping portion 108*b* of frame 102; and (ii) first and second opposing foot supports 122*a-b* movably coupled to crank 120. In one implementation, the crank 120 is coupled to the telescoping portion 108*b* through a bracket (not shown). For example, the bracket may comprise a securing portion at the lower end of the bracket for securing the bracket to the telescoping portion 108*b*. The bracket may further comprise an extension that terminates in a perpendicular axle. The crank 120 may then be mounted on the bracket about the axle. In another implementation, the axle can extend from an inner wall of the elliptical device 104 housing.

In the illustrated implementation, the crank 120 further comprises means for providing the back ends of the opposing foot supports 11*a-b* with cyclical motion. To provide such a motion, the illustrated crank 120 comprises a flywheel 124 that rotates about an axis. The flywheel 124 comprises pivoting rods 126*a-b* that are mounted about the flywheel 124 periphery, and that extend in opposite directions relative to each other. In the illustrated implementation, one pivoting rod 126*a* is positioned approximately 180° about the flywheel 124 periphery relative to the other pivoting rod 126*b*. The opposing foot supports 122*a-b* are then pivotally joined to the flywheel 124 at the respective, pivoting rods 126*a-b*. When the flywheel 124 turns a given direction, the back end of the foot supports 122*a-b* move in a respectively cyclical motion about the flywheel 124 axis.

One will appreciate, however, that other implementations of a crank 120 can be used in accordance with the present invention. For example, the crank can comprise two opposing arms that rotate about an axis, such as bicycle-type crank arms (not shown), wherein the back end of the foot supports 122*a-b* pivotally connect to the extreme ends of the arms. In another implementation, the crank comprises two opposing flywheels rotating about the same axis, wherein one pivoting rod extends from one flywheel, and the opposing rod extends in an opposite direction from the opposing flywheel. In each case, the given crank simply provides the foot supports 122*a-b* with cyclical motion.

Continuing with the elliptical device 104, the front ends of the respective foot supports 122*a-b* comprise respective wheels 123*a-b* that are configured to move in basically linear back and forth motions. In use, wheels 123*a-b* of respective foot supports 122*a-b* contact and move back and forth within grooves on the stationary portion 108*a* of frame 102. This results in an overall elliptical motion for the elliptical device 104 when combined with the cyclical motion of the foot support 122*a-b* back ends.

Elliptical device 104 further comprises (i) a resistance wheel 128 movably coupled via a belt to flywheel 124; and (ii) a resistance mechanism that adjustably applies resistance to the resistance wheel 128 (e.g., through magnetic resistance), which together serve to adjust resistance to the movement of flywheel 124.

Thus, in the implementation shown in FIG. 1A, the operable components (e.g., foot supports 12*a-b* and crank 120) of elliptical device 104 are coupled to the telescoping portion 108*b* of frame 102, whereby such components of device 104 are easily positioned close to or away from strength training device 106. Such operable components can be coupled alternatively to stationary portion 108*a* of frame 102, while the anaerobic device 106 can be coupled to the telescoping portion 108*b*. In such an alternative embodiment, the anaerobic device 106 may be movably positioned with respect to the aerobic device 104.

Also as shown in FIGS. 1A and 1B, elliptical device 104 further comprises first and second user stabilizing handles 140 (only one shown handle 140 shown) coupled to opposing sides of upstanding member 114 and extending rearward in order to be conveniently grasped by a user. Stabilizing handles 140, can provide balance during certain exercises, and may also include sensors (not shown) that measure the user's pulse during still other exercises. Upstanding member 114 further provides a convenient post on which to mount some or all of the components of anaerobic device 106.

Anaerobic device 106 comprises (i) a resistance assembly 118 coupled to the front portion of upstanding member 114; and (ii) one or more exercise stations, such as pull handles 142*a-d* linked to resistance assembly 118 via a pulley and cable system that is coupled to and extends through frame 102. Resistance assembly 118 provides adjustable resistance to movement of handles 142*a-d*. FIGS. 1A and 1B generally depict the components and use of resistance assembly 118 in solid and broken lines. As shown, resistance assembly 118 comprises a resistance assembly frame 143 that is coupled to upstanding member 114. The additional components of resistance assembly 118 will be described in additional detail below.

Implementations of the exercise system 100 include one or more electronic consoles 144 that gathers, receives, processes, and displays data between one or more components (e.g., stabilizing handles 140), as well as the aerobic, elliptical device 104 and anaerobic, strength training device 106. For example, data received from sensors mounted on opposing right and left stabilizing handles 140 are output directly at a display interface on the electronic console 144, thereby indicating the user's heart rate. Furthermore, data received from each of elliptical device 104 and strength training device 106 can be combined, processed, and displayed as appropriate back to the user.

With continued reference to FIGS. 1A-B, system 100 can further comprise additional features which aid the user in either comfort or balance. For example, a pad 150 is attached to upright member 114, and can be useful as a knee pad when a user is facing pad 150, or as a backrest when a user is seated (as in FIG. 1B), or when the user is facing away from pad 150 and desires to rest against it, depending upon a given exercise. Furthermore, a pad 152 is mounted on a housing 121 surrounding the crank 120, forming a padded bench on which a user can sit while performing exercises.

A leg exercise system, such as a leg extension assembly 153, comprising a leg extension bar 154 is movably coupled to pad 152, thereby enabling knee extension exercises. The leg extension assembly 153 further comprise leg contact members 155 (only one shown) on opposing sides of bar 154. A cable may connect a hook 156 mounted on bar 154 to resistance assembly 118 (e.g., by connecting to handle 142*a* or a connector associated therewith). The cable may extend from hook 156 through hooks 158*a-b* to handle 142*a* (or an associated connector) in order to keep the cable away from the operable components of elliptical device 104.

In one implementation, a user may desire to sit on the pad 152 and perform anaerobic, strength training exercises at one or more exercise stations when crank 120 is positioned close to strength training device 106 (e.g., as in FIG. 1B). This can enable the user to lean back against pad 150 when sitting to perform certain exercises, e.g., by pulling one or more handles 142*a-d*, or by performing leg extensions against using assembly 153. Of course, specific positioning of crank 120 with respect to the anaerobic device 106 is not required for all aerobic or anaerobic activity on exercise system 100.

FIG. 1B further shows that the exercise system 100 can comprise multiple electronic consoles in an electronic console system, such as electronic consoles 144*a* and 144*b* (phantom). For example, one electronic console 144*a* can be mounted directly to the frame 114, while another electronic console 144*b* can be embedded inside pad 152 so that it is viewed when the user is seated. In one embodiment, one electronic console 144*a* is configured to display primarily aerobic data, while a second electronic console 144*b* is configured to display anaerobic data based on use of the strength training device 106. In other embodiments, the exercise system 100 can further comprise an electronic console system having three or more electronic consoles for specific exercise devices, as appropriate.

Thus, for example, a workout or training program can be geared to display information through each of the one or more electronic consoles (e.g., one console—144, or multiple consoles—144*a*, 144*b*, etc., as appropriate). In particular, the workout or training program can be configured to output elliptical workout instructions, and elliptical data at one display interface (e.g., console 144, or 144*a*, as appropriate), and, at an appropriate time, output strength training workout instructions and related strength training workout data at the same or another display interface (e.g., console 144, or 144*b*, as appropriate). For example, strength training and elliptical exercise data can be displayed at one or more corresponding display interfaces at one electronic console 144. Alternatively, elliptical data can be displayed through one or more corresponding display interfaces at electronic console 144*a*, while strength training data is displayed only at the corresponding one of multiple electronic console 144*b*.

In this manner, one console 144 or multiple consoles 144*a*, 144*b* of the exercise system 100 (which are user linked), can be utilized to perform "circuit training" with anaerobic and aerobic exercises. In general, circuit training involves implementation of an exercise program to direct a user to perform certain exercises on one machine, and other exercises on another machine. This can be done through displays at one console, or through multiple displays (e.g., first and second displays) at respective multiple consoles. For example, an exercise program can be displayed to a user through a first console display at one exercise device, telling a user to perform 15 minutes of aerobic training; and then the program can direct the user to another, second, console display, where the second display tells the user to perform 25 repetitions of another exercise on a strength training device, and so forth. In one implementation, the circuit training identifies the user or exercise data as it is performed, can modify its instructions accordingly, and completes after the user has finished the instructions shown at each corresponding one or more displays.

Figure 2A:
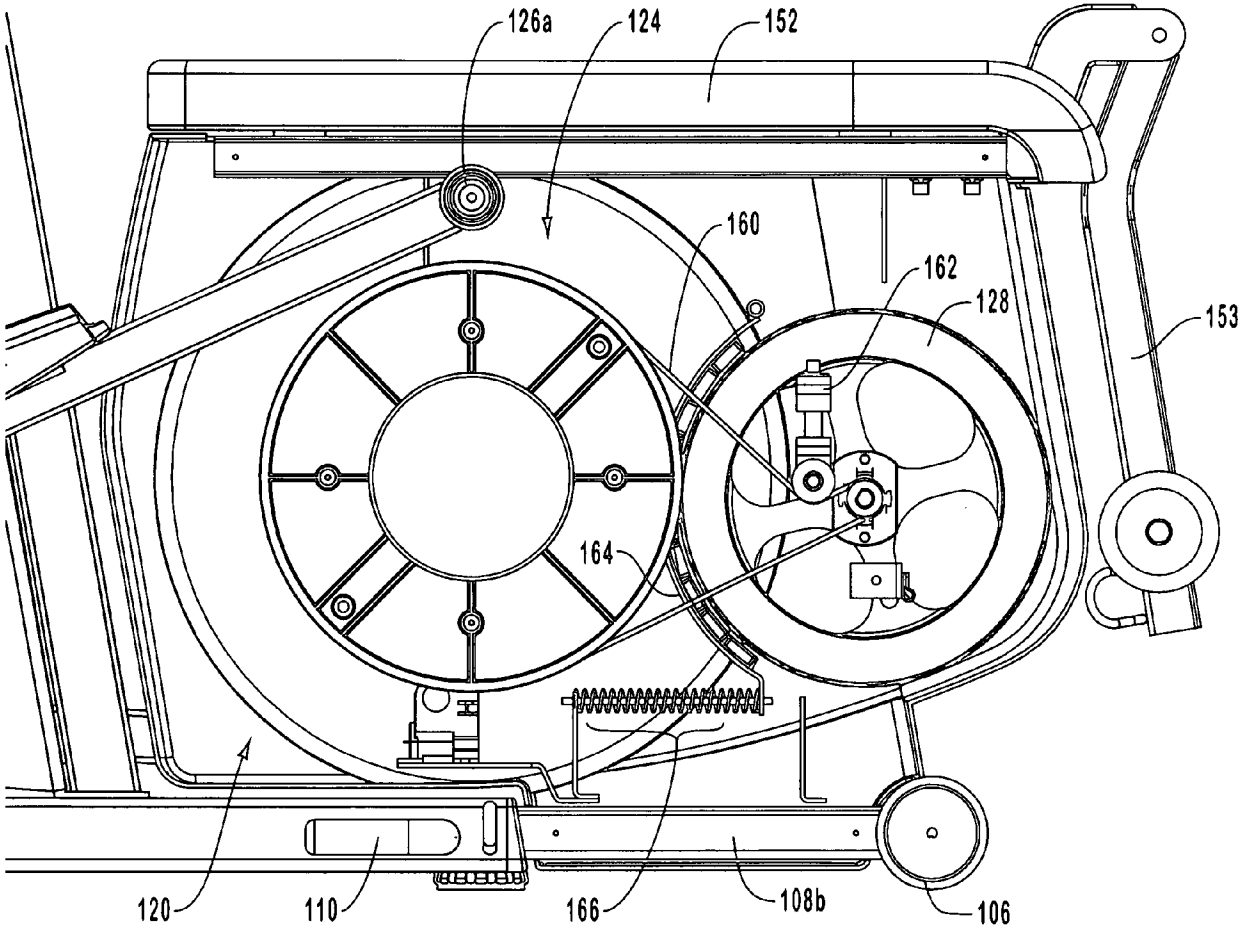
FIG. 2A is a close up, side view of the operating components of the elliptical device of the exercise device of FIGS. 1A-2A.

FIG. 2A and the following discussion outline the elliptical device 104 in greater detail. For example, the illustrated elliptical device 104 comprises pivoting rods 126*a* and 126*b* that connect the respective backend of a foot support (e.g., 122*a* and 122*b*) to flywheel 124. Belt 160 couples the flywheel 124 to the resistance-based, flywheel 128. A belt tensioner 162, positioned along the belt 160, can help keep the belt tensioned so that it does not slip out of position.

The elliptical device 104 also comprises a "C"-shaped aerobic resistor 164 for adjusting the elliptical resistance, wherein the aerobic resistor 164 can be varied at least in part by a spring-based adjustment system 166. For example, aerobic resistor 164 is configured such that contraction of the aerobic resistor 164 by the spring-based adjustment system slows the movement of the resistance flywheel 128; while releasing the braking mechanism 164 frees the motion of the resistance flywheel 128. In one implementation, the aerobic resistor 164 may comprise eddy magnet brakes, although a wide variety of brakes or other resistance apparatus can be used within the context of the invention. The spring adjuster 166 contracts or expands the aerobic resistor 164 relative to the resistance flywheel 128. In one implementation, the spring adjuster 166 may be adjusted based on user input (e.g., through electronic signals sent from the console 144 to a motor coupled to the spring adjuster 166).

Figure 2B:
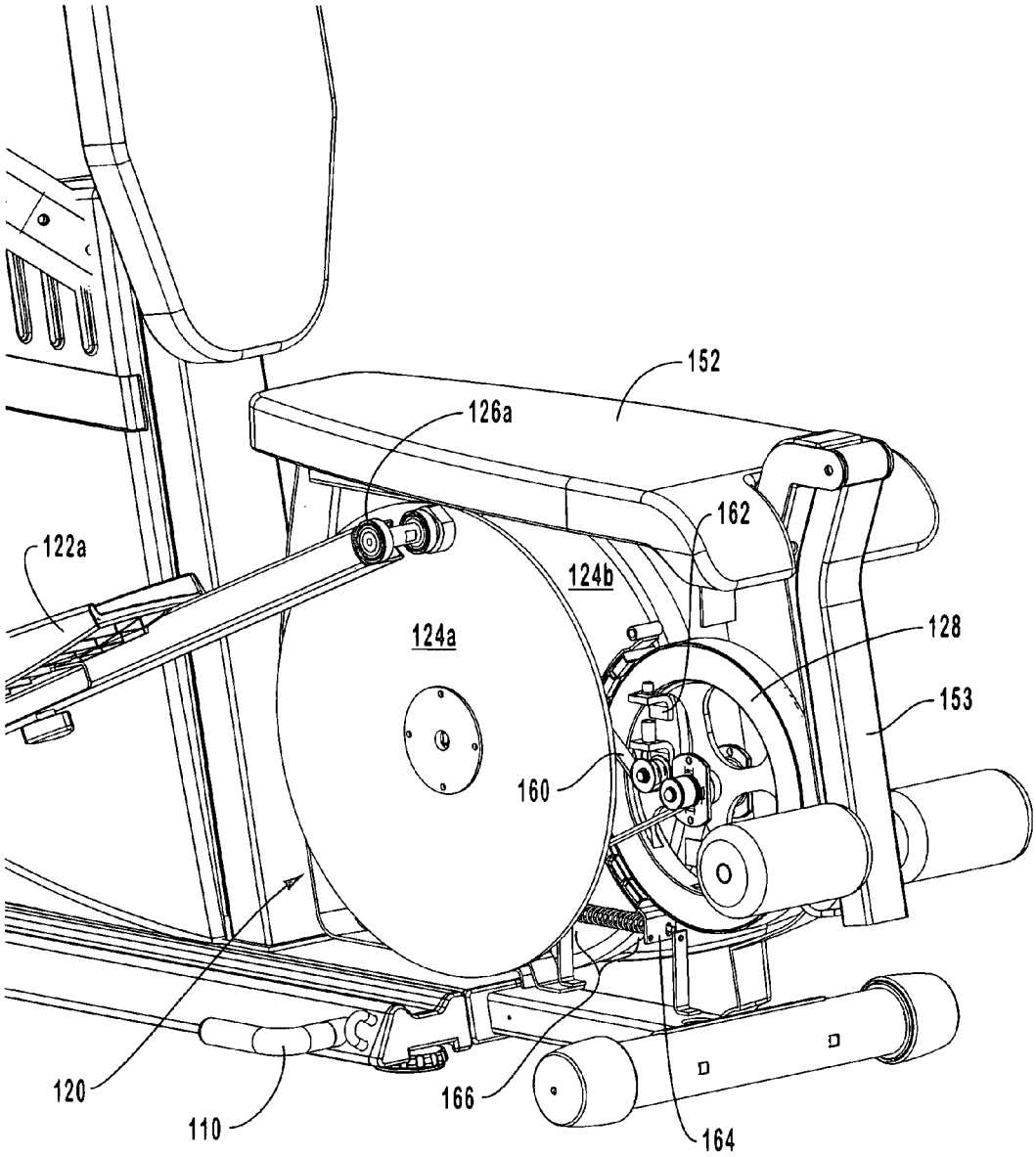
FIG. 2B is a side perspective view of the elliptical device depicted in FIG. 2A.

The implementation of FIG. 2B further shows that the pivoting rod 120 comprises two solid disk flywheels 124 (i.e., 124*a* and 124*b*). In particular, the flywheels 124*a-b* are each connected about an axle, where one disk is connected to a foot support 122*a* through a pivoting rod 126*a*, while another disk is connected to the other foot support 122*b* through another pivoting rod 126*b*. Alternatively, the flywheel 124 may comprise one solid disk positioned about an axle, where the flywheel 124 also connects to the respective foot supports with respective pivoting rods 126*a* and 126*b*. Generally, a solid disk flywheel 124 can provide additional balance and stability to the elliptical exercise system 104, in addition to some cost considerations. For example, it may be less expensive, in some implementations, to use a solid disk as the outer wall of an aerobic system 104 housing 121.

Figure 3:
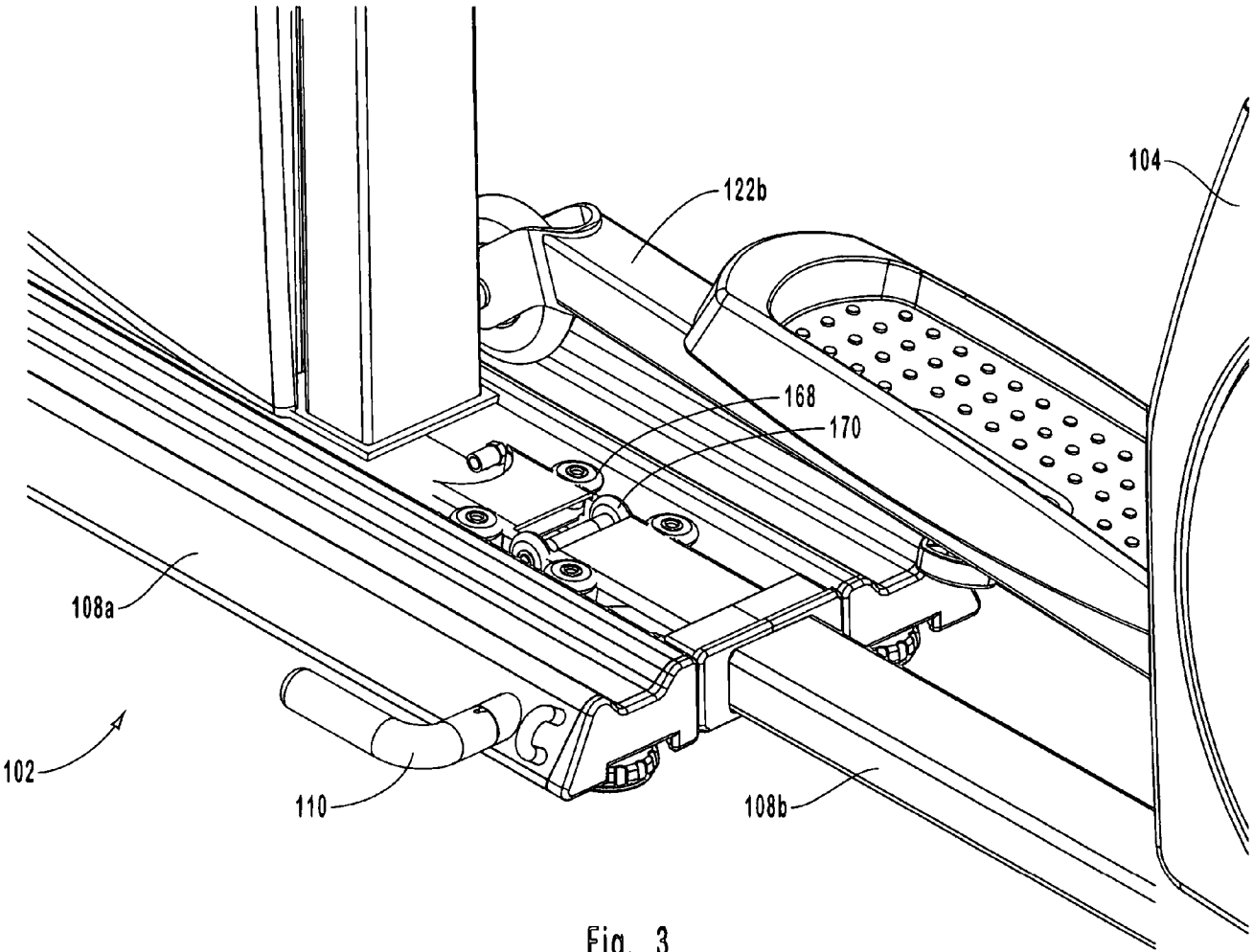
FIG. 3 is a close up, top perspective view of a telescoping portion of the frame of the exercise system depicted in FIGS. 1A-2A.

FIG. 3 and the following description provide detail concerning the telescoping frame 102 and associated components. For example, as shown in FIG. 3, one or more inner side rollers 168 roll along the side walls of the inner cavity in the stationary portion 108*a*. As well, one or more bottom rollers 170 roll along the lower surface of the inner cavity of the stationary portion 108*a*. At least one advantage to using side and bottom rollers in this manner is that rollers 168 and 160 can help metallic frame parts move together much more fluidly than, for example, using only grease to overcome frictional forces. Furthermore, the ease of movement provided by the described rollers can make the compacting and expanding ability of the exercise system 100 accessible to any user.

Figure 4:
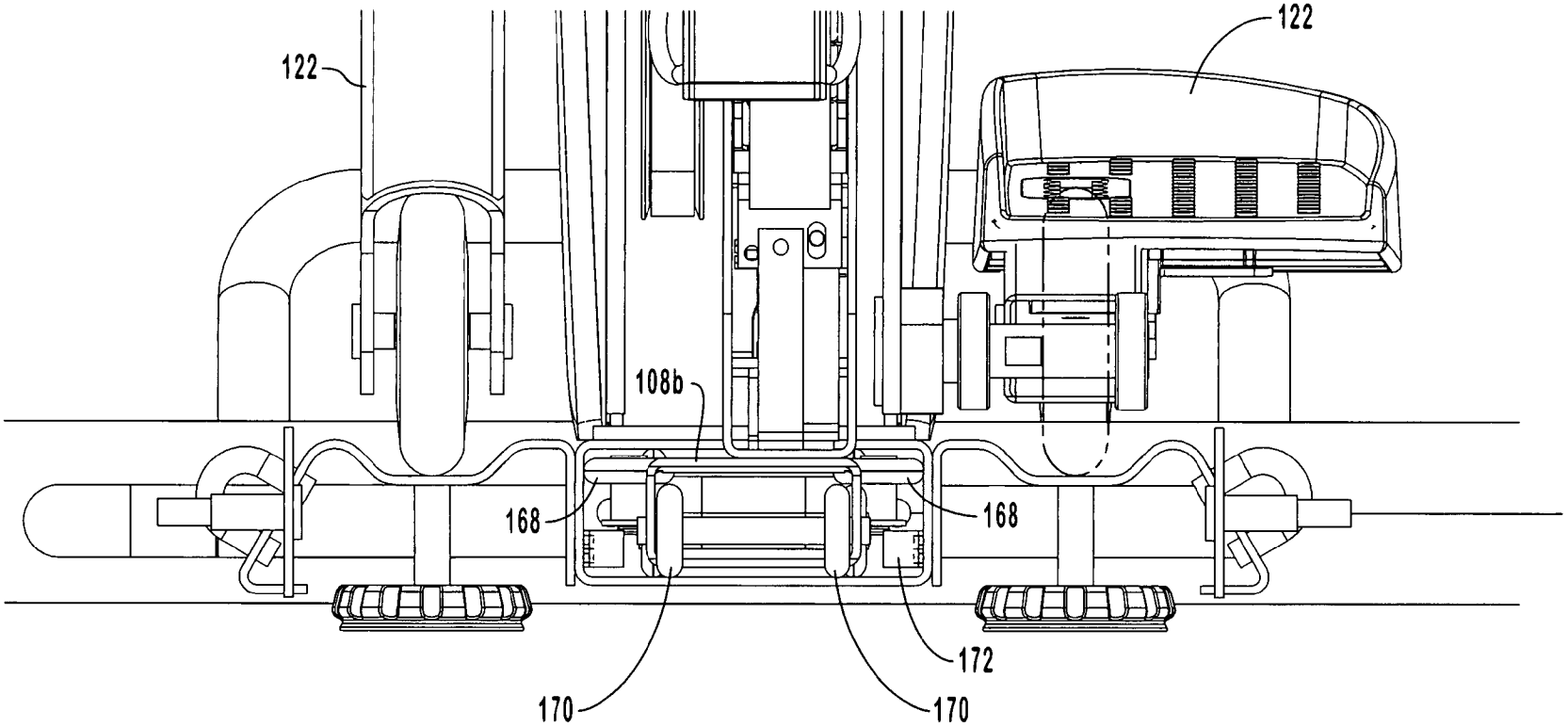
FIG. 4 is a close up, front view of the telescoping frame shown in FIG. 3.

FIG. 4 illustrates a front view of the telescoping portion 108*b* when the telescoping portion 108*b* is positioned within the stationary portion 108*a*, such that the exercise system 100 is compacted. In one implementation, one or more stoppers set toward the front of the stationary portion 108*a* may be used to set a maximum insertion point of the telescoping portion 108*b*. This can be done when one or more of the wheels 160 of the telescoping portion 108*b* abut the one or more respective stoppers of the stationary portion 108*a* when the exercise system 100 is fully compacted. In another implementation, one or more back stoppers (not shown) can be used to set a maximum expansion point of the telescoping portion 108*b* relative to the stationary portion.

Figure 5A:
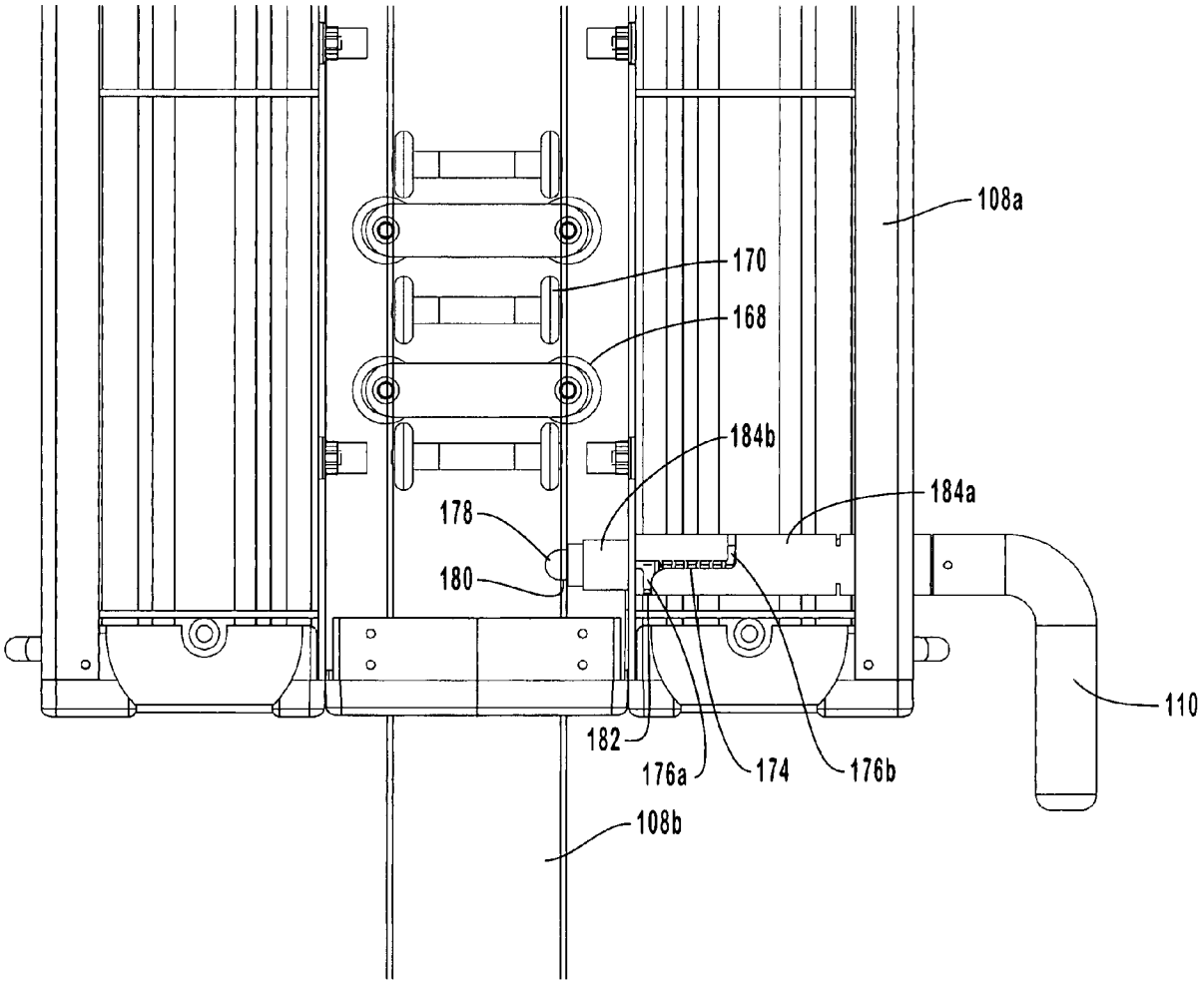
FIG. 5A is a plan view of a release handle and related components of the telescoping frame shown in FIG. 3.

At or between the maximum and minimum compaction points, releasable securing means, such as release handle 110, can be used to secure the telescoping portion 108*b* in various positions. For example, FIG. 5A illustrates a release handle 110 in an engaged (or "secured") position with respect to the stationary portion 108*b*. As used herein, the term "engaged" can refer generally to a position of the release handle 110, in which the telescoping portion 108*b* can be prohibited from compacting or expanding, relative to the stationary portion 108*a*. Conversely, the term "disengaged" or "released", with reference to the release handle 110, can refer to the position of the release handle 110 in which the telescoping portion 108*b* can be free to contract or expand with respect to the stationary portion 108*a*.

As further illustrated in FIG. 5A, an implementation of the release handle 110 comprises (i) an outer sheath 184*a*, which resides primarily inside the stationary portion 108*a* of the telescoping frame 110; (ii) a spring bias 174 within the outer sheath 184*a*; (iii) one or more inner sheaths 184*b* extending from the outer sheath 184*a*; and (iv) a detent 178 that is biased by the spring 174. When a user moves the release handle 110, the user compresses the spring bias 174 as the user moves the handle 110 in toward the telescoping portion 108*b*. In so doing, the user extends the handle detent 178 from the one or more inner sheaths 184*b* into a respective cavity 180 in the telescoping portion 108*b*. The user locks the release handle 110 into position by rotating the handle, such that a shaft detent 182 slips into securing slot 176*a*.

Figure 5B:
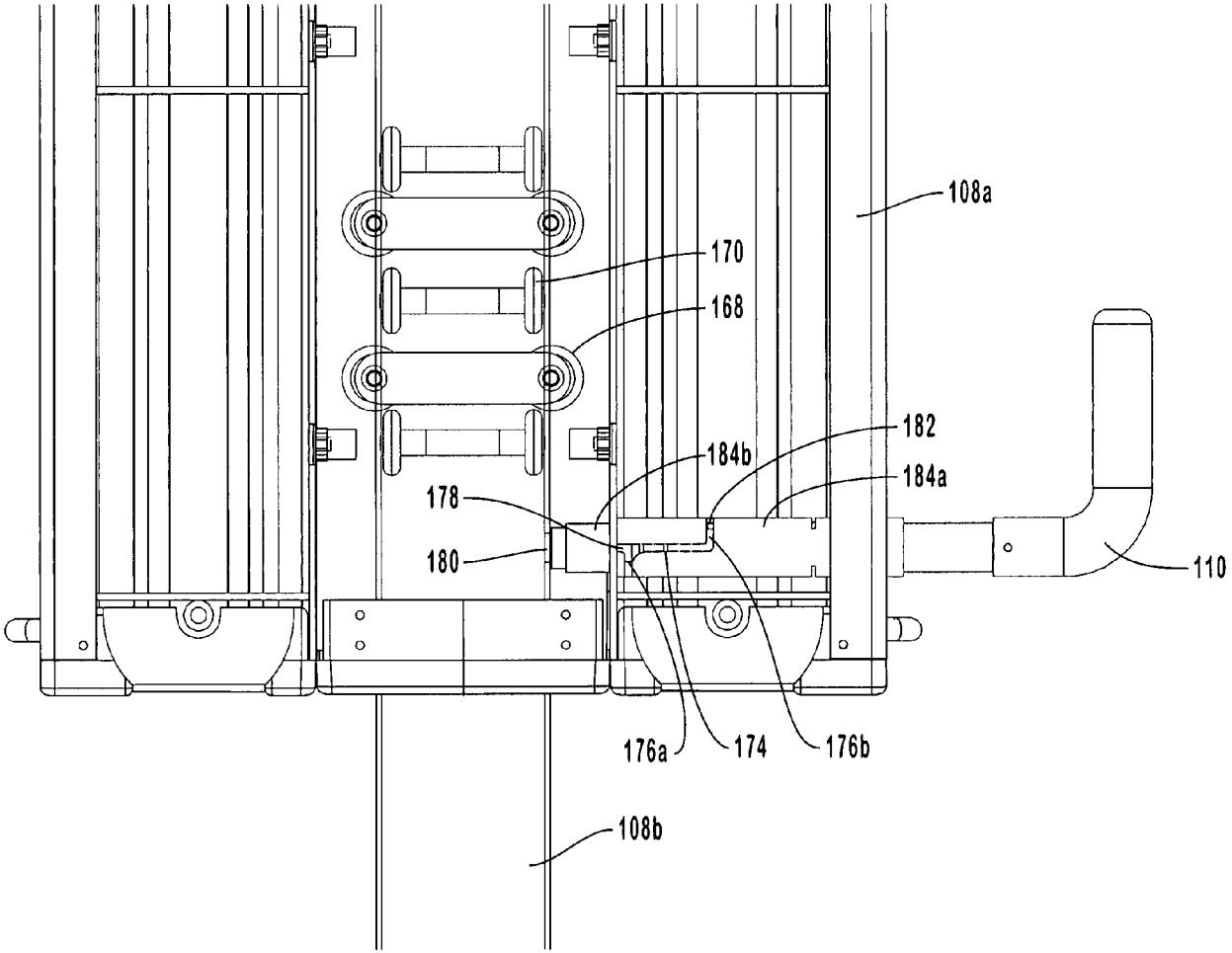
FIG. 5B is a plan view of the release handle and related components depicted in FIG. 5A, wherein the release handle and related components are disengaged.

A user can, of course, also disengage the release handle 110 so that the telescoping portion 108*b* can be repositioned with respect to the stationary portion 108*a*. As shown in FIG. 5B, for example, the release handle 110 is rotated and released (e.g., pulled or pushed) away from the stationary portion 108*a*, such that the handle detent 178 pulls out of the groove or cavity 180. In one particular implementation, when a user rotates the release handle, the springs 174 become uncompressed, and force the handle 110 into an extended position. Once the handle is extended, the user then locks the handle 110 in the disengaged position by positioning shaft detent 182 into slot 176*b*. The telescoping portion 108*b* can then move freely with respect to the telescoping portion 108*a*. One will appreciate that the stability of such a locking mechanism is particularly important for a user performing relevant exercises such as on the exercise system 100.

Figure 6A:
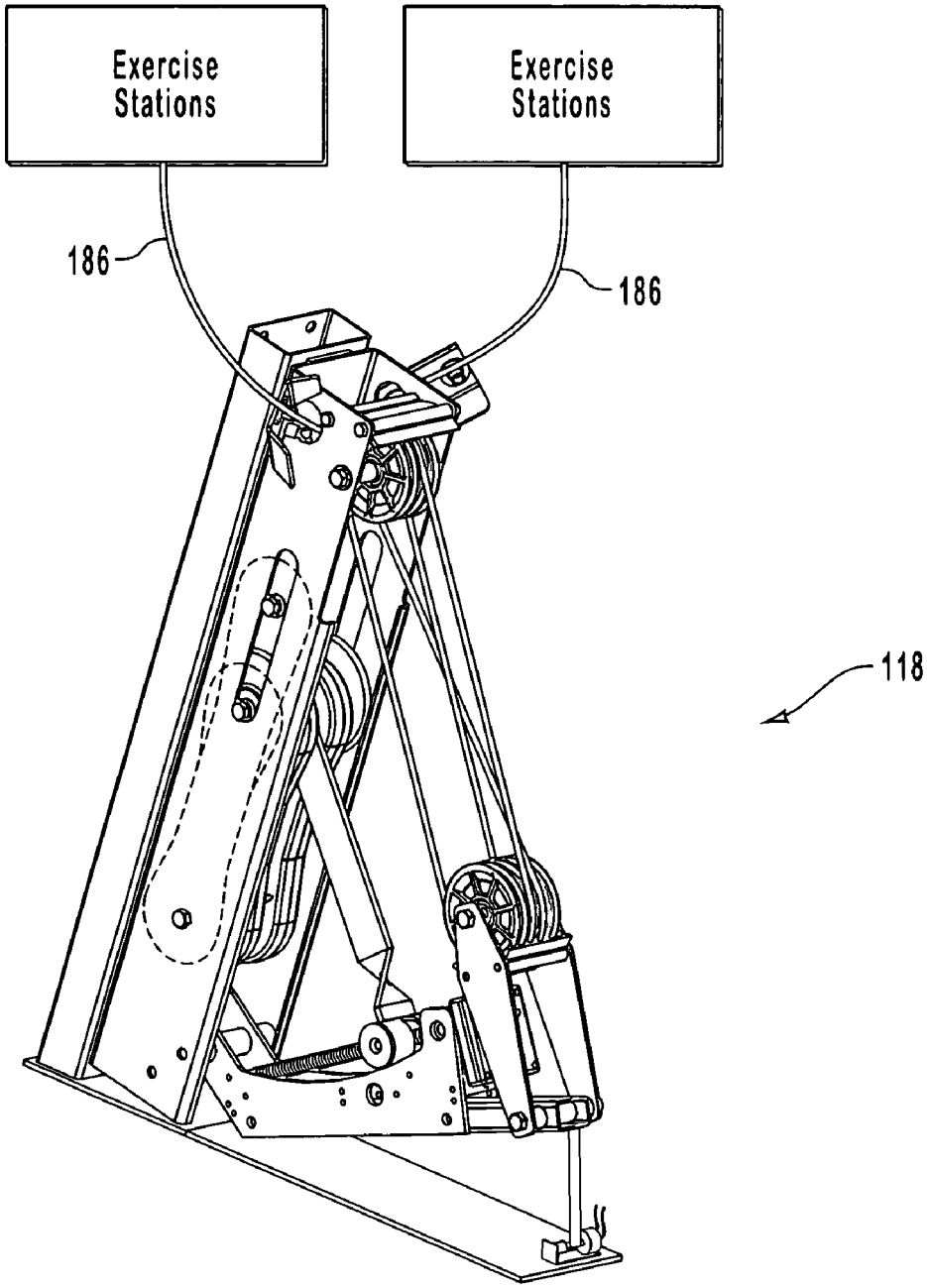
FIGS. 6A and 6B are side perspective views of an anaerobic resistance assembly and repetition sensor of the exercise system of FIGS. 1A and 1B.
Figure 6B:
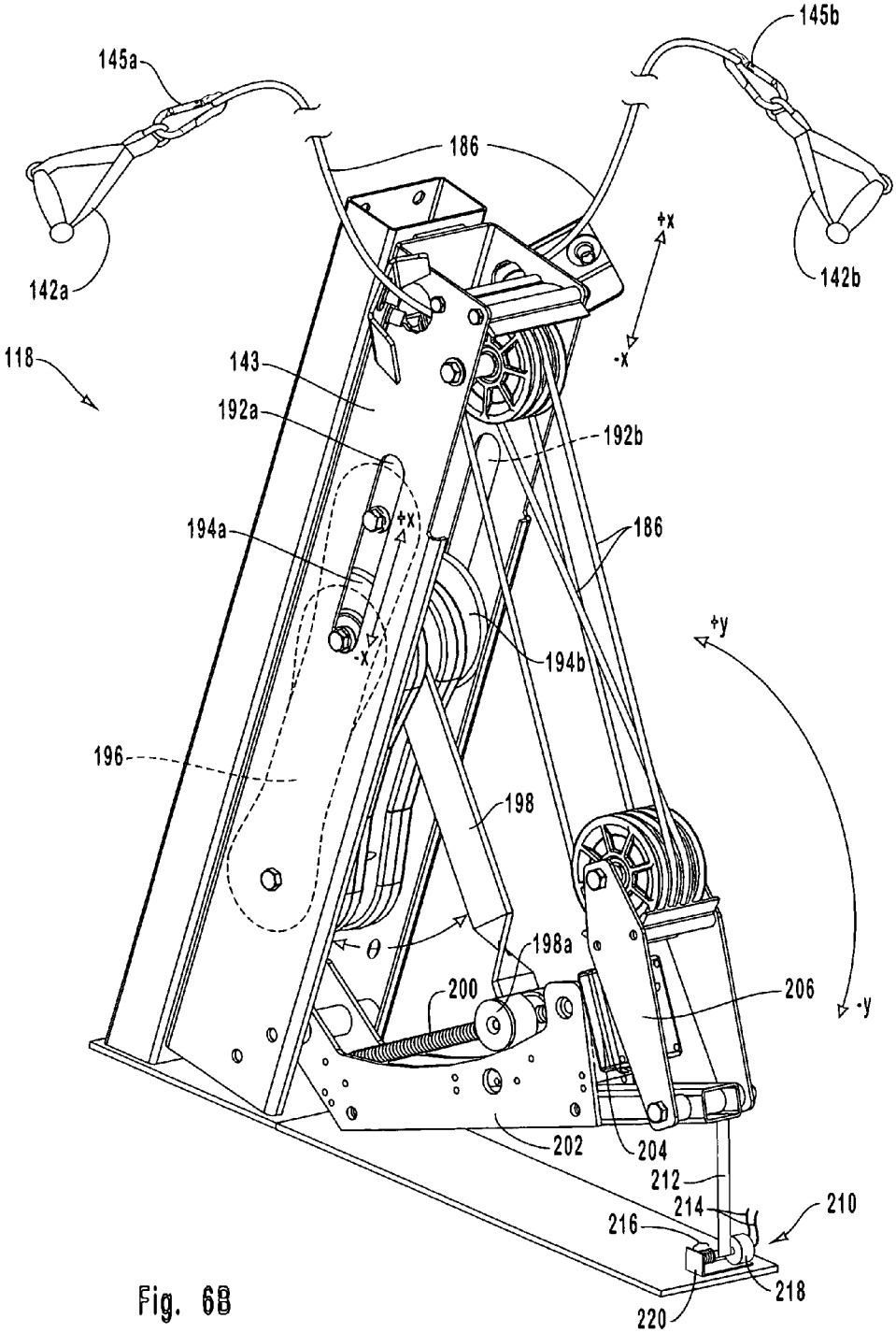

FIGS. 6A-6B and the following description provide greater detail regarding the resistance assembly 118 of strength training portion 106 (see also FIGS. 1A-1B). In particular, FIG. 6A illustrates a schematic overview of one resistance assembly 118 having cables 186 that couple the resistance assembly 118 to one or more exercise stations. FIG. 6B provides a more particular illustration of the resistance assembly 118 shown in FIG. 6A, further showing the one or more operations for the respective resistance and repetition counting parts.

In general, resistance assembly 118 is configured such that, when a user exerts a force by pulling one or more pull handles 142*a-d*, leg extension assembly 153 or another suitable exercise station, a respective cable 186 pulls against a resistance provided by resistance assembly 118. Resistance assembly 118 may be employed as a self-contained assembly that may be portable to a variety of different exercise systems. Similar and alternative representations and operations of the depicted resistance assembly 118 are described in U.S. Pat. No. 6,685,607, filed on Jan. 10, 2003, entitled "EXERCISE DEVICE WITH RESISTANCE MECHANISM HAVING A PIVOTING ARM AND A RESISTANCE MEMBER", the entire contents of which are incorporated herein by reference.

As shown, resistance assembly 118 comprises: (i) a frame 143 configured to be mounted to an exercise device frame, such as frame 102; (ii) a cable 186 having opposing ends that are configured to be coupled to one or more exercise stations, e.g., handles 142*a-b*; (iii) a pair of resilient resistance bands 196, each coupled at a lower end thereof to frame 143; (iv) a "primary" pivoting plate assembly 202 movably coupled below bands 196 to frame 143; and (v) a threaded drive member 200 movably coupled to the pivoting plate assembly 202. The illustrated resistance assembly 118 still further comprises: (vi) a cross beam 198 movably coupled to the threaded drive member 200 at one end via threaded pivoting member 198*a*, and, at an upper end, the cross beam 198 is coupled to another end of the resilient resistance bands 196. The respective bands 196 are therefore connected to cross beam 198 in such a way that the respective bands 196 are moveable within respective slots 192*a* in frame 143.

The illustrated resistance assembly 118 yet still further comprises: (vii) a motor 204 configured to selectively turn threaded drive member 200; (viii) a "secondary" pivoting plate assembly 206 movably coupled to primary pivoting plate assembly 202; and (ix) a series of pulleys mounted to frame 143 and the secondary pivoting plate assembly 206, for receiving or transferring cable 186 therein. In general, cable 186 extends through one or more cavities in frame 143, as shown in FIGS. 6A-B, around the corresponding pulleys, and ultimately back into respective exercise handle stations coupled to frame 143 (e.g., handles 142*a-b*). Secondary cables may be coupled to handles 142*c-d* and to respective coupling joints 145*a-b* of cable 186.

Upon movement of an exercise station, such as handle 124*a*, pivoting plate assembly 202 moves against resistance provided by resilient resistance bands 196, as depicted by the extended broken lines shown in FIGS. 6A-B. The resistance applied by bands resistance can be adjusted by adjusting the position of cross beam 198 along threaded drive member 200. Such adjustment can occur by actuating drive motor 204 to thereby turn threaded drive member 200 within threaded pivoting member 198*a* of cross beam 198. Threaded drive member 200 can thus be turned to move cross beam 198, and hence change the angle against which force is applied to the resilient bands 196, hence changing resistance. In at least one implementation, drive motor 204 is configured to rotate the threaded drive member 200 based on one or more electrical signals that may be received from console 144, for example.

In particular, when the respective cable 186 moves upward (+x), pivoting plate assembly 202 is pulled in an upward, arcuate manner (+y) toward the resistance assembly frame 143. In addition, the cross beam 198 rotates about the threaded pivoting member 198*a* 116*a*, which is in a fixed position set at least in part by the motor 204. This movement of the cross beam 198 causes the flexible resilient bands 196 to stretch in a respective direction (+x) along the slots 192*a*. As shown, stretching of the resilient resistance bands 196 along the assembly slots 192*a* and 192*b* (+/−x) may be facilitated at least in part by resistance wheels 194*a-b*.

When the user releases the force, such as by releasing the pulling handle (e.g., 142*a*), the respective cable 186 moves back toward the resistance frame 111 (−x). This causes the pivoting plate assembly 202 to move in the reverse arcuate direction (−y). This further causes the cross beam 198 and resilient resistance bands 196 to move or contract in reverse directions (−x), such that the cables 186 and resilient bands 196 are in a relatively relaxed state.

One can appreciate, therefore, that the position of the cross beam 198 relative to the resistance assembly frame 143 has an effect on the angle at which the resilient resistance bands 196 are stretched. In particular, a smaller angle θ between the cross beam 198 and resilient resistance bands 196 provides a greater leverage angle (i.e., easier) to stretch the bands 196, while a greater angle θ provides a lesser leverage angle (i.e., more difficult) to stretch the bands in the resistance member 118. Thus, the resistance of the resistance assembly 118 in FIGS. 6A-6B can be adjusted by adjusting the resistance angle θ, which can be implemented by threaded pivoting member 198*a* along the threaded drive member 200.

In particular, the assembly motor 204 is electrically coupled to the electronic console 144 via respective circuit wires (not shown). The motor 204 can be configured in one implementation to adjust the resistance of the resistance assembly 118 based on user input. For example, when the user selects an anaerobic resistance value, such as by selecting a resistance value at an input interface at the electronic console 144, a respective electronic signal sent to the motor 204 causes the motor 204 to rotate the threaded drive member 200 a certain amount. The cross beam 198 thus moves along the threaded drive member 200 into a new position, which further causes the pivoting plate assembly 202 to be positioned closer to (or further from) the resistance assembly frame 143.

FIGS. 6A and 6B further illustrate a repetition sensor 210 that may be used in accordance with the exercise system 100. In particular, one implementation of a repetition sensor 210 comprises a voltage generator 218 having a frame 220 that is mounted to the resistance assembly 118, a spring bias 216, and a coupling member 212 (such as a ribbon) that is attached to the pivoting plate assembly 202. When the pivoting plate assembly 202 moves with a user's exercise motion, the coupling member 212 moves a corresponding direction, causing the voltage generator 218 to send an electrical signal to the electronic console 144 through respective electrical wires 210.

A more particular description of using a voltage generator as a repetition sensor to detect anaerobic repetitions is found in commonly-assigned U.S. patent application Ser. No. 10/916,687 of Kowallis, et al., filed on Aug. 11, 2004 via U.S. Express Mail Number EV 432 689 389 US, entitled "REPETITION SENSOR IN EXERCISE EQUIPMENT", the entire contents of which are incorporated herein by reference. Other sensors may be employed to sense various parameters of the components of the exercise system 100, such as resistance at the strength training device 106.

The exercise system 100 can also be configured to provide a user with a digital readout of the resistance level chosen. As shown in FIGS. 1A-B, and 6A-B, for example, the electronic console 144 can be connected to an anaerobic meter 210, such as a repetition sensor 210, for monitoring anaerobic exercises. The electronic console 144 can also be connected to a conventional aerobic meter (not shown) for monitoring aerobic exercise data. The electronic signals received from the anaerobic and aerobic meters (as well as, for example, the stabilizing handles 140) then combines, processes, and/or displays data to the user at the electronic console 144, as appropriate.

Furthermore, an implementation of the electronic console 144 comprises an input interface so that a user can control anaerobic or aerobic resistance, rates of exercise, and so forth.

For example, a user can select a level of anaerobic resistance at an input interface at the electronic console 144. The electronic console 144 can then interpret the user input, and send a respective electronic signal to the drive motor 204 of the resistance assembly 118. After receiving the electronic signal, the motor 204 can then rotate the threaded drive member 200 until the resistance assembly 118 is set to the desired resistance. One will appreciate that similar mechanisms is used to control the resistance and exercise rate of the aerobic exercise system 140. Accordingly, a wide variety of electronic console mechanisms and displays is employed within the context of the present invention.

Figure 7:
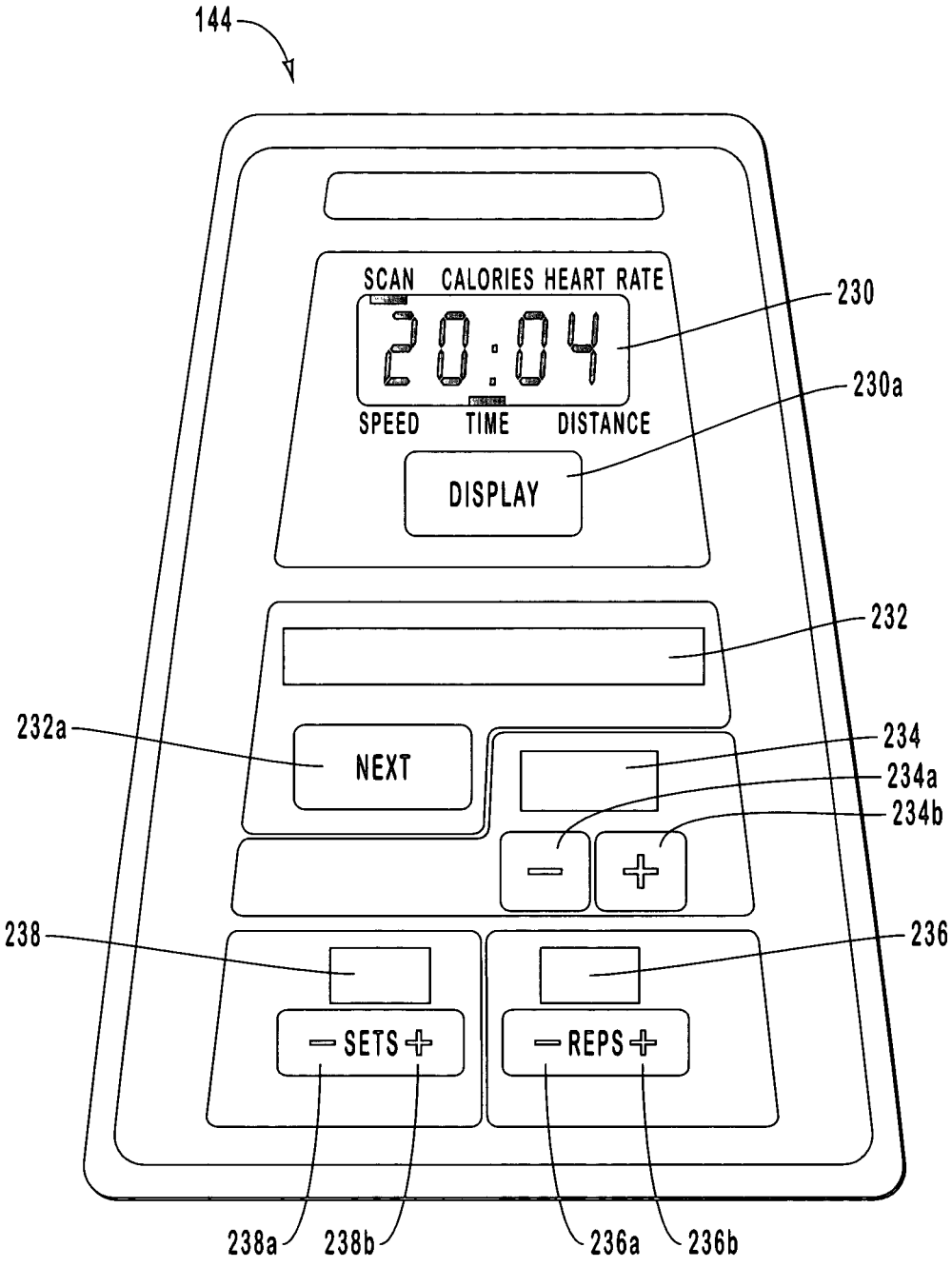
FIG. 7 is front view of an electronic console of the exercise system of FIGS. 1A and 1B for managing anaerobic and aerobic exercise information in accordance with an implementation of the present invention.

FIG. 7 illustrates an implementation of one electronic console 144 that can be used in an electronic console system in accordance with the present invention. In particular, the depicted electronic console 144 can be configured to have input and output displays for both a strength training device 106 and an elliptical device 104. For example, with respect to aerobic exercise data, such an electronic console 144 comprises a counter interface 230 that displays incremental factual data such as calories burned, heart rate, speed of exercise time of exercise, and distance traveled. In one implementation, the user's heart rate is measured from sensors at handles 142*a-d*, etc. and/or sensors at stabilizing members 140. A selectable "Display" button 230*a* provides a user with the ability to change which data (e.g., which value of time, speed, distance, etc.) are displayed to the user at a given point in time.

Although such incremental data is typically applicable for aerobic data, display interface 230 can be implemented with aerobic and anaerobic data, as appropriate. The depicted electronic console 144 further comprises one or more interfaces for providing interactive views and data options. For example, the electronic console 144 comprises a display interface 232 that may be used for indicating the type of program or workout routine in which the user is engaged. A selectable "Next" button 232*a* allows a user to scroll, for example, from one program option to the next.

In addition, the depicted electronic console 144 comprises a resistance interface 234 that allows a user to increase or decrease resistance of the strength training device 104 and the elliptical device 104. For example, the illustrated electronic console 144 can also comprise a selectable decrement button 234*a* (e.g., "–") and a selectable increment button 234*b* (e.g., "+") for making the respective resistance adjustments. In one implementation, for example, input from the user at buttons 234*a* and 234*b* causes the electronic console 144 to send a respective data signal to the elliptical device 104, thereby causing the aerobic resistor 164 to change positions (hence resistance).

The depicted electronic console 144 still further comprises additional display interfaces that may be particularly useful for anaerobic exercise data. For example, the electronic console 144 comprises a display interface 236 for setting, displaying, or modifying the number of exercise repetitions, and a similar display interface 238 for setting, displaying, or modifying the number of exercise repetition sets. In particular, selectable "–" button 236*a* and selectable "+" button 236*b* may be configured so that a user can set a target number of reps in a routine. Furthermore, selectable "=" button 238*a*, and selectable "+" button 238*b* may also be configured so that a user can set a target number of sets in a routine.

An exemplary electronic console 144, therefore, can take input from the user via one or more selectable buttons (e.g., 230*a*, 232*a*, 234*a*, 234*b*, etc.), and send a respective data signal to the respective aerobic or anaerobic exercise system, as appropriate. Similarly, the electronic console 144 can take an input from the electronic console 144 and send a respective data signal to circuitry in the resistance assembly 118, thereby causing the motor 204 to modify the position of the cross beam 198 relative to the resilient resistance bands 196, hence change resistance. Of course, the electronic console 144 can also receive electronic signals from the elliptical exercise device 104, the resistance assembly 118, and the gripping handles 142*a-d*, and provide the user with relevant information through the relevant display interfaces 230, 232, 234, 236, and 238.

One will appreciate that the foregoing description for an electronic console in an electronic console system can also be readily modified for multiple electronic consoles in an electronic console system. For example, an elliptical electronic console 144*a* (see FIG. 1B) can comprise display interfaces 230, 230*a*, and 232, while a strength training electronic console 144*b* (see FIG. 1B) can comprise display interfaces 232, 232*a*, 234, 234*a-b*, 236, 236*a-b*, 238, and 238*a-b*. In short, there are a variety of ways in which one or more electronic consoles can be configured to display data to a user at one or more positions on an exercise system 100. Furthermore, there are a variety of ways in which each such electronic console can be configured to receive specific types of input from a user, or from a given exercise device (e.g., elliptical device 104, strength training device 106).

Figure 8:
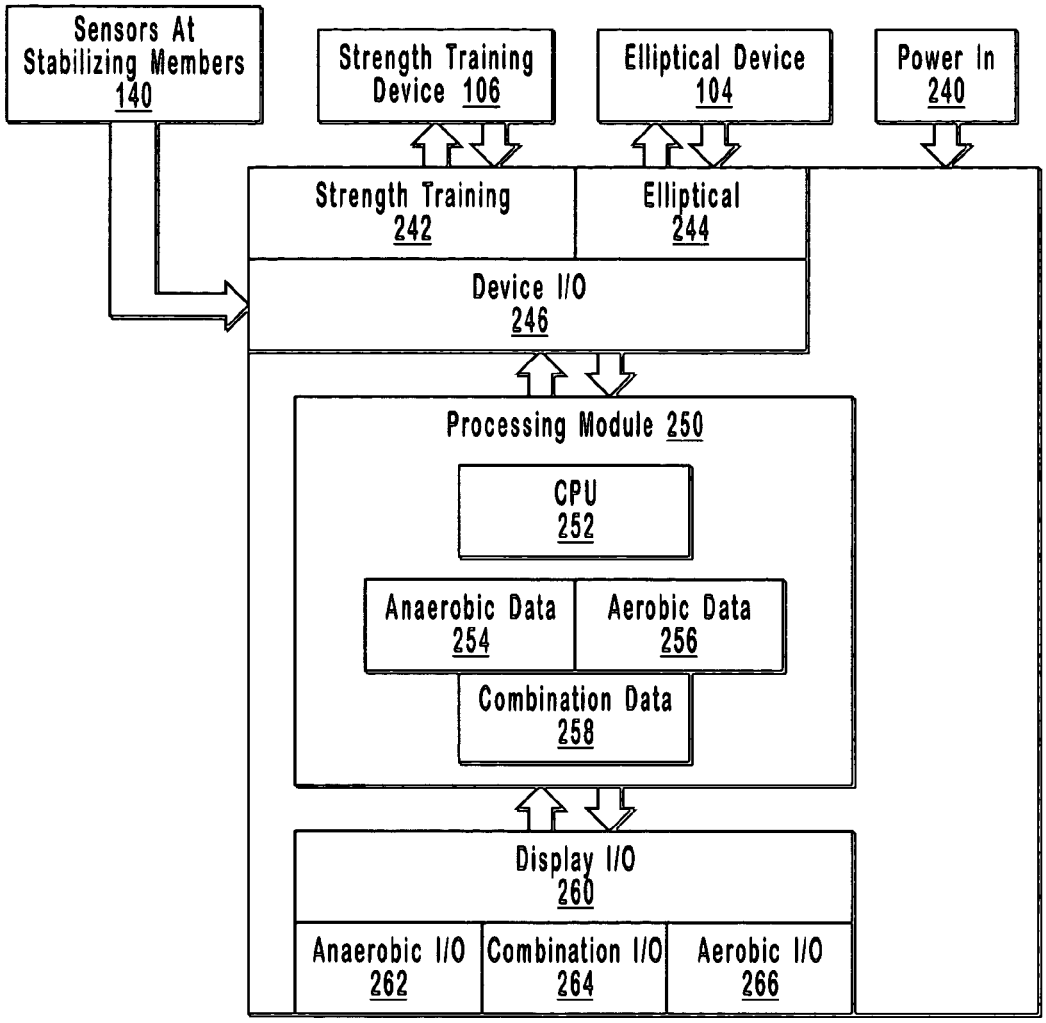
FIG. 8 is a software block diagram for receiving, processing, and displaying information on an electronic console such as the console of FIG. 7.

FIG. 8 illustrates one embodiment of the present invention, in block diagram form, representing software modules and system components that are suitable for implementing an electronic console 144 that displays elliptical data and strength training data in an electronic console system. For example, an embodiment of an electronic console 144 comprises a connection to a power source 240, and further includes a Device I/O (Input/Output) module 246 for receiving and transferring electronic signals. In particular, Device I/O module 246 comprises circuitry for two-way strength training communication 242 to the strength training exercise device 106, and comprises circuitry for two-way elliptical communication 244 to the elliptical exercise device 104. The electronic console 144 further comprises an interface for receiving data from sensors at, for example, the stabilizing members 140, etc.

In addition, the exemplary electronic console 144 comprises a processing module 250 that includes, for example, a central processing unit 252 and any other necessary active and/or passive circuitry components to operate the exercise system 100. For example, the processing module can comprise volatile or non-volatile memory, any magnetic or optical storage media, any capacitors and resistors, any circuit traces for transferring data between components, any status indicators such as light emitting diodes, and any other processing components and so forth as may be appropriate.

The electronic console 144 itself may also comprise additional input and output components such as an Ethernet connection port, a telephone connection port, audio in and out ports, optical in and out ports, wireless reception and transmission ports, and so forth. One will appreciate, therefore, that, for the purposes of convenience, not all components and circuit traces that may be used are shown in FIG. 8.

As shown, the exemplary electronic console 144 comprises a connection to a Display I/O module 260. In particular, Display I/O module 260 comprises user-interactive display components such as a two-way strength training I/O component 262 for receiving and displaying strength training data (i.e., "anaerobic" data 254) to and from a user. The Display I/O module 260 comprises a two-way combination I/O component 264 for receiving and displaying combination data 258 to and/or from the user, and a two-way elliptical I/O component 264 for displaying to the user (and/or receiving from the user) elliptical data (i.e., "aerobic data") 256. In one implementation, combination I/O data includes data that is not uniquely strength training or elliptical-based information. For example, combination I/O data may include selection of a generalized workout routine at interface 232, wherein the workout routine includes instructions to the electronic console 144 for both elliptical and strength training resistance levels.

In operation, the processing module 200 can receive anaerobic, or strength training, data 254, aerobic, or elliptical, data 256, and combination data 258 from any of the respective strength training device 106, elliptical device 104, and the user. For example, the strength training device 106 may send one or more electronic signals to the electronic console 144. In one implementation, these signals indicate to the electronic console 144 the amount of strength training resistance, or identify the number of strength training exercise repetitions performed, and so forth.

In addition, sensors in, for example, the stabilizing handles 140, can send data signals to the electronic console 144 that can indicate the user's pulse rate count. Similarly, the elliptical system 104 may send one or more respective electronic signals to the electronic console 144, such that the electronic console 144 can identify the amount of elliptical resistance, the number of revolutions of the flywheel 124, the speed of the flywheel 124, and so forth.

In addition to data received from the exercise portions 104, 106, and any other sensors, etc., the processing module 250 can also receive user input through the console's 144 interactive displays. This user-provided input can include selections for change in resistance, a change in speed, a change in incline, a change in exercise programs, and so forth. The processing module 250 can also receive user data such as the user's weight, age, height, and any other relevant data that may be useful for providing the user with accurate feedback, or for modulating the duration and intensity of a given workout.

When the processing module 250 receives appropriate data, a CPU 252 at the processing module 250 can then execute instructions. For example, the CPU can combine various data such as age, heart rate, exercise speed, weight, resistance, and other such parameters to provide the user with an accurate depiction of the calories burned, distance traveled, and so forth. In some cases, the CPU 252 may simply report the received data directly to a user display, and thus formats received data signals so that they can be read at a respective display. In other cases, the CPU 252 may simply calculate the data using one or more equations, as appropriate, before providing the user with a display value. In still other cases, the CPU 252 may simply format data received from a user (or surmised from a workout), and send the formatted data as a respective electronic signal to a motor at an exercise portion (e.g., 104, 106), and so forth.

One will appreciate, of course, that an electronic console system configured to implement multiple electronic consoles (e.g., 144*a*, 144*b*, etc.) may vary the implementation of the foregoing software modules and connection interfaces, as appropriate. For example, an electronic console 144*a* configured to display elliptical data may comprise elliptical communication circuitry 244, aerobic I/O component 266, and corresponding processing modules. By contrast, an electronic console 144*b* configured to display strength training data may comprise strength training circuitry 242, as well as the anaerobic I/O component 262, and corresponding processing modules.

Accordingly, the various implementations of the present invention enable a user to readily perform a wide range of elliptical and strength training exercises that are an important part of a workout routine. In particular, the various implementations of the present invention enable a user to perform a wide variety of strength training and elliptical exercises in a relatively small space since the exercise system is compacted or expanded by virtually any user. In addition, electronic data options provide a user with the ability to monitor and/or manipulate data for a wide range of strength training and elliptical exercises.

In addition, one of ordinary skill will appreciate that any number of strength training resistance systems such as those related to weight stacks, coil springs, shocks, elastomeric bands, resistance rods or bows or the like may be substituted for the present cable and pulley resistance system 106 within the context of the invention. Furthermore, any number of elliptical exercise systems such as steppers, gliders, skiers, striders, treadmills, exercise bikes, and so forth, can also be implemented in place of the depicted elliptical exercise system 104 within the context of the invention. Thus, an exercise system 100 of the present invention comprises (i) a first exercise device, e.g., elliptical device 104 coupled to frame 102 and (ii) a second exercise device e.g., strength training system 106 coupled to the frame. Frame 102 is configured such that at least a portion of the first exercise device can be compacted and expanded with respect to at least a portion of the second exercise device.

Another advantage of system 100 is that strength training exercise device 106 is operable independently from elliptical exercise device 104. Thus, one user may use elliptical device 104 while a different user uses strength training device 106. Another advantage of system 100 is that it features an elliptical exercise device, i.e., elliptical device 104, linked to an anaerobic exercise device 106 through frame 102, wherein at least a portion of the elliptical exercise device is movably coupled to at least a portion of the strength training device, such that the exercise system is capable of being moved from a compact position to an extended position. For example, it may be more convenient for a first user to use the strength training device 106, and for a second user to use the elliptical exercise device 104, while system 100 is in an extended position.

Figure 9A:
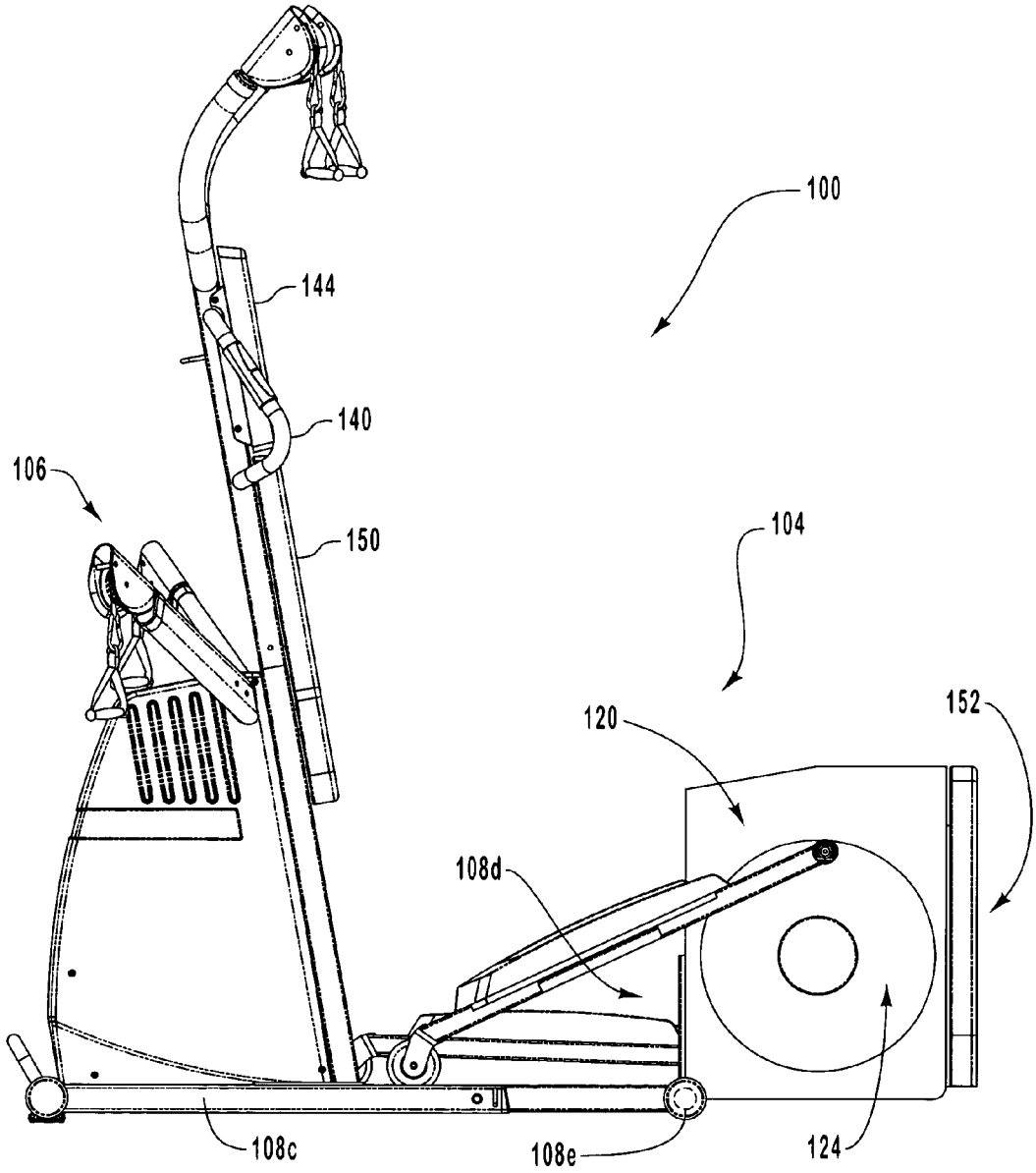
FIG. 9A is a side view of an elliptical device mounted on another embodiment of a multi-part frame, wherein the elliptical device is expanded relative to the strength training device in a pivoting fashion.
Figure 9B:
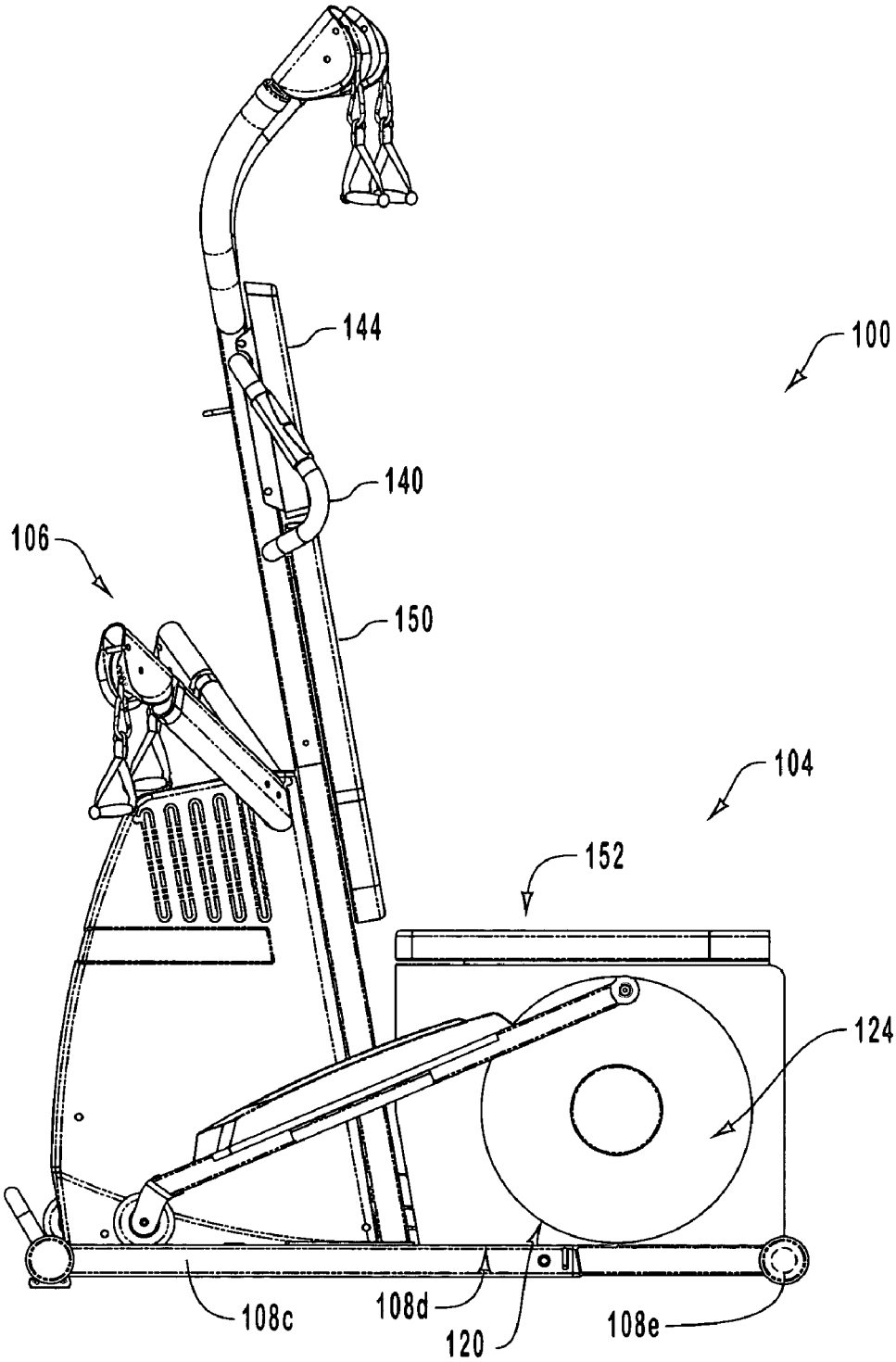
FIG. 9B is a side view of FIG. 9A wherein the elliptical device is compacted relative to the strength training device in a pivoting fashion.

The present invention has been described with continued reference to a telescoping frame 102. The telescoping frame, however, is simply one example of a multi-part frame which acts as an implementation for coupling two exercise devices in this manner. As shown in FIGS. 9A and 9B, for example, telescoping frame 102 is replaced by a pivoting frame, which is another example of a multi-part frame. In particular, one portion of an exercise device, such as the crank of an elliptical exercise device, may be coupled to a primarily stationary portion 108*c* of the pivoting frame, while a second exercise device may be coupled to a mobile portion 108*d* that swings about a pivot point 108*e*.

In particular, FIG. 9A shows that a portion of the elliptical device 104 can be tilted away from the strength training device 106 for performing elliptical exercises. By contrast, FIG. 9B shows that the portion of the elliptical device 104 can be tilted toward the strength training device 106, such as when performing strength training exercises. As such, one will appreciate that there are a number of ways for providing a multi-part frame having multiple exercise devices thereon.

Exercise system 100 disclosed herein may optionally be referred to as comprising: (i) an elliptical exercise assembly, comprising: (A) a frame 102; (B) a crank 120 movably coupled to frame 102; and (C) first and second foot supports 122*a-b* movably coupled to the crank 120; and (ii) a second exercise device (e.g., strength training device 106) coupled to the elliptical exercise assembly. At least a portion of the elliptical exercise assembly can be movably positioned closer to and further away from at least a portion of the second exercise device.

It should therefore be appreciated that the present invention may be embodied in other forms without departing from its spirit or essential characteristics. As properly understood, the preceding description of specific embodiments is illustrative only and in no way restrictive. The scope of the invention is, therefore, indicated by the appended claims as follows.

We claim:

1. A compactable, elliptical exercise device comprising:

a multi-part frame having a front frame portion and a rear frame portion, the front and rear frame portions being adapted to be positioned on a support surface during exercise, wherein the rear frame portion is movably coupled to the front frame portion, wherein the rear frame portion is selectively moveable between: (i) an extended, elliptical operating position, in which the rear frame portion and the front frame portion are extended with respect to each other for performing elliptical exercises; and (ii) a compact position in which the rear frame portion and the front frame portion are selectively compacted with respect to each other;

a crank movably coupled to the rear frame portion, wherein the crank is adapted to move toward the front frame portion as the rear frame portion is selectively moved to the compact position, wherein at least a portion of the crank is positioned over the front frame portion when the rear frame portion is in the compact position; and first and second foot supports movably coupled to the crank and wherein at least a portion of the first and second foot supports contact and move in a substantially horizontal plane within a portion of the front frame portion such that the first and second foot supports can move in an elliptical motion, wherein the elliptical exercise device is configured to be selectively moved between the compacted position and the extended, elliptical operating position.

2. An exercise device as recited in claim 1, wherein the frame is a pivoting frame, such that the exerciser can move the device from the compacted position to the extended, elliptical operating position by pivoting the rear frame portion away from the front frame portion.

3. An exercise device as recited in claim 1, wherein the frame is a telescoping frame such that the rear frame portion moves with respect to the front frame portion.

4. An exercise device as recited in claim 1, wherein a first end of each of the first and second foot supports is pivotally coupled to the crank, and wherein a second end of each of the first and second foot supports moves along a surface of the front frame portion such that the first and second foot supports each engage in an elliptical motion.

5. An exercise device as recited in claim 1, wherein the exercise device further comprises a strength training, anaerobic system mounted on the front frame portion, wherein the strength training system comprises a strength training exercise device that is operable independently from the elliptical exercise device.

6. An exercise system as recited in claim 5, wherein the strength training device comprises a cable and pulley system coupled to a resistance mechanism.

7. An exercise system as recited in claim 6, wherein the resistance mechanism comprises at least one resilient band.

8. An exercise device as recited in claim 1, wherein the rear frame portion has a padded seat mounted thereon.

9. An exercise device as recited in claim 1, wherein a portion of the elliptical exercise device can be movably positioned closer to or further way from at least another portion of the elliptical exercise device.

10. An exercise system as recited in claim 1, wherein the front frame portion comprises an upright portion having handles thereon for grasping by a user.

11. An exercise device as recited in claim 1 wherein the front frame portion includes a track along which the first and second foot supports move.

12. An exercise device as recited in claim 1, wherein a user can perform elliptical exercises when the exercise device is in the operating position and wherein the user can perform strength training exercises when the exercise device is in the compact position.

13. An exercise system as recited in claim 1, wherein the front frame portion comprises a stationary portion and the rear frame portion comprises a telescoping portion.

14. An elliptical exercise device as recited in claim 1, wherein the elliptical exercise device comprises at least one flywheel for facilitating elliptical motion, and a resistance device coupled to the at least one flywheel.

15. An exercise device as recited in claim 1, further comprising an electronic console having one or more circuitry components for use in combination with the exercise device, the electronic console comprising:

one or more processing modules configured to process electronic data signals received from the exercise device;

one or more first display interfaces for displaying anaerobic exercise data relayed from the one or more processing modules; and one or more second display interfaces for displaying aerobic exercise data relayed from the one or more processing modules.

16. An exercise device as recited in claim 15, further comprising an input interface for adjusting one or more of an adjustable anaerobic resistance member and an adjustable aerobic resistance member.

17. An exercise device as recited in claim 15, wherein the aerobic exercise data comprise one or more of: (i) time spent exercising, (ii) calories burned, (iii) heart rate during exercise, (iv) exercise speed, and (v) exercise distance.

18. An exercise device as recited in claim 15, wherein the anaerobic exercise data comprise at least one of: (i) a number of repetitions desired, (ii) a number of repetitions performed, (iii) a number of sets desired, and (iv) a number of sets performed.

19. A compactable, elliptical exercise device comprising:

a multi-part frame having a front frame portion and a rear frame portion, the front and rear frame portions being adapted to be positioned on a support surface during exercise, wherein the rear frame portion is movably coupled to the front frame portion, wherein the rear frame portion is selectively moveable between: (i) an extended, elliptical operating position, in which the rear frame portion and the front frame portion are extended with respect to each other for performing elliptical exercises; and (ii) a compacted, elliptical storage position, in which the rear frame portion and the front frame portion are selectively compacted with respect to each other;

a crank movably coupled to the rear frame portion, wherein the crank is adapted to move toward the front frame portion as the rear frame portion is selectively moved to the compacted, elliptical storage position, wherein at least a portion of the crank is positioned over the front frame portion when the rear frame portion is in the compact position;

first and second foot supports movably coupled to the crank such that the first and second foot supports can move in an elliptical motion, wherein the elliptical exercise device is configured to be selectively moved between the compacted, elliptical storage position and the extended, elliptical operating position; and a strength training device coupled to the front frame portion, wherein when the rear frame portion is in the compacted, elliptical storage position, a user can perform strength training exercises utilizing the strength training device.

20. An exercise device as recited in claim 19, further comprising at least one electronic console system, the exercise device configured to enable anaerobic and aerobic exercises, wherein the multi-part frame has a first exercise device portion and a second exercise device portion coupled thereto, further comprising a first electronic display interface configured to display electronic signals from the first exercise device portion, and a second electronic display interface configured to display electronic signals from the second exercise device portion.

21. An exercise device as recited in claim 20, wherein the first and second electronic display interfaces are both linked to at least one of the first and second exercise device portions of the exercise device.

22. An exercise device as recited in claim 20, wherein the first electronic display interface is configured to display aerobic exercise instructions to a user; and wherein the second electronic display interface is configured to display anaerobic exercise instructions to the user.

23. An exercise device as recited in claim 20, wherein the first electronic display interface and the second electronic display interface display exercise data on a single electronic console.

24. An exercise device as recited in claim 20, wherein the first electronic display interface and the second electronic display interface display exercise data a plurality of electronic consoles.

25. An exercise device as recited in claim 20, wherein the first electronic display interface and the second electronic display interface provide a user with workout instructions to perform circuit training on the exercise device.

26. An exercise device as recited in claim 25, wherein the workout instructions to the user comprise at least one of (i) an anaerobic activity at the first exercise device portion; and (ii) an aerobic activity at the second exercise device portion.

27. An exercise device as recited in claim 26, wherein the first exercise device portion is coupled to the front frame portion of the frame; and wherein the second exercise device portion is coupled to the rear frame portion of the frame.

28. A compactable, elliptical exercise device comprising:

a multi-part frame having a front frame portion and a rear frame portion, the front and rear frame portions being adapted to be positioned on a support surface during exercise, wherein the front frame portion comprises at least one wheel stop, wherein the rear frame portion is movably coupled to the front frame portion, wherein the rear frame portion is selectively moveable between: (i) an extended, elliptical operating position, in which the rear frame portion and the front frame portion are extended with respect to each other for performing elliptical exercises; and (ii) a compact position in which the rear frame portion and the front frame portion are selectively compacted with respect to each other;

a crank movably coupled to the rear frame portion, wherein the crank is adapted to move toward the front frame portion as the rear frame portion is selectively moved to the compact position, wherein at least a portion of the crank is positioned over the front frame portion when the rear frame portion is in the compact position; and first and second foot supports movably coupled to the crank, wherein the first and second foot supports each comprise a wheel adapted to contact and move back and forth in a substantially horizontal plane along the front frame portion such that the first and second foot supports can move in an elliptical motion, wherein the at least one wheel stop is adapted to receive and fix at least one of the wheels of the first and second foot supports therein when the rear frame portion is in the compact position.

29. An exercise device as recited in claim 28, further comprising an electronic console system coupled to the frame, the electronic console system comprising:

one or more processing modules configured to process electronic data signals;

one or more first display interfaces for displaying anaerobic exercise data relayed from the one or more processing modules; and one or more second display interfaces for displaying aerobic exercise data relayed from the one or more processing modules.

* * * * *

UNITED STATES PATENT AND TRADEMARK OFFICE

CERTIFICATE OF CORRECTION

PATENT NO. : 7,740,563 B2
APPLICATION NO. : 10/916684
DATED : June 22, 2010
INVENTOR(S) : Dalebout et al.

It is certified that error appears in the above-identified patent and that said Letters Patent is hereby corrected as shown below:

The title page showing the illustrative figure should be deleted to be replaced with the attached title page.

Drawings

The drawing sheet, consisting of Fig. 1A, should be deleted to be replaced with the drawing sheet, consisting of Fig. 1A, as shown below.

Sheet 1, replace Figure 1A with the figure depicted below, wherein the second instance of "142c" has been changed to --142a-- and the second instance of "158a" has been changed to --158b--

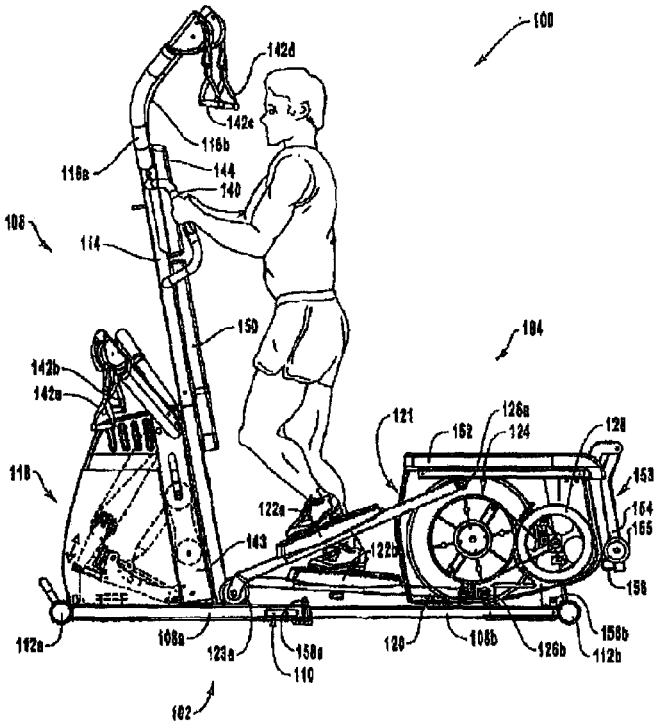

Fig. 1A

Signed and Sealed this
Fourth Day of January, 2011

David J. Kappos

David J. Kappos
*Director of the United States Patent and Trademark Office*

Sheet 3, replace Figure 2A with the figure depicted below, wherein the reference number "106" has been changed to --112b--

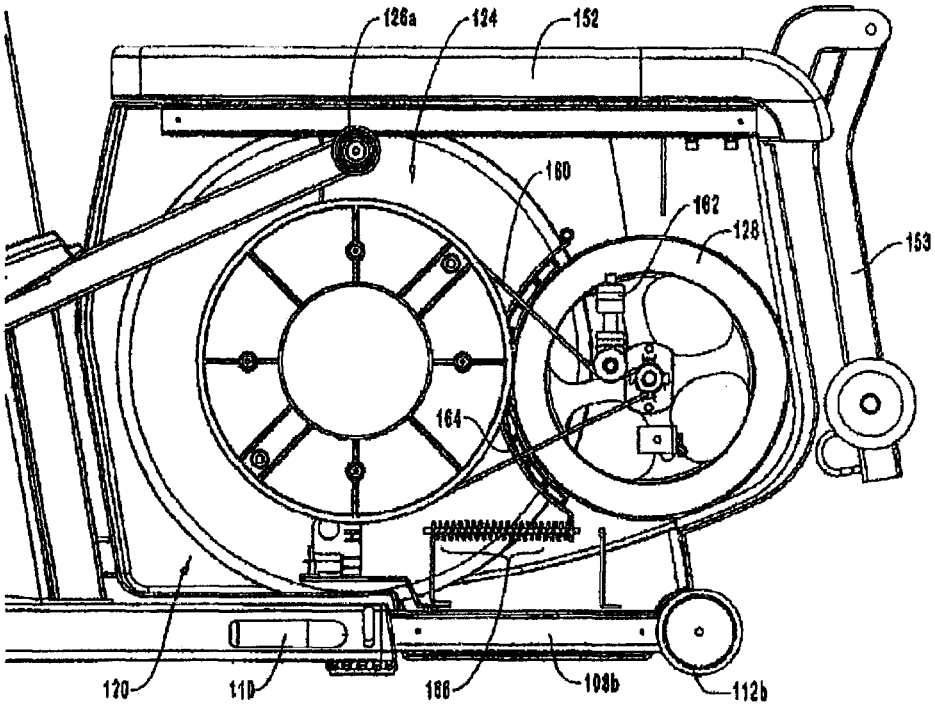

Fig. 2A

Column 9
Line 39, change "124*a*" to --142*a*--
Line 57, after "198*a*" remove [116*a*]
Line 60, change "slots 192*a*" to --slots 192*a-b*--
Line 66, change "resistance frame 111" to --resistance frame 143--

Column 10
Line 12, change "resistance member" to --resistance assembly--
Line 42, change "210" to --214--
Line 56, after "anaerobic meter" remove [210]

Column 11
Line 10, change "exercise system 140" to --exercise system 104--
Line 21, after "exercise" insert --,--
Line 40, change "strength training device 104" to --strength training device 106--
Line 59, change ""="" to --"–"--

Column 12
Line 67, change "component 264" to --component 266--

Column 13
Line 9, change "processing module 200" to --processing module 250--

Column 17
Line 41, change "data a plurality" to --data on a plurality--

(12) United States Patent
Dalebout et al.

(10) Patent No.: US 7,740,563 B2
(45) Date of Patent: Jun. 22, 2010

(54) ELLIPTICAL EXERCISE MACHINE WITH INTEGRATED ANAEROBIC EXERCISE SYSTEM

(75) Inventors: William T. Dalebout, North Logan, UT (US); Michael L. Olson, Logan, UT (US); Darren C. Ashby, Richmond, UT (US); Darren Zaugg, Providence, UT (US)

(73) Assignee: Icon IP, Inc., Logan, UT (US)

( * ) Notice: Subject to any disclaimer, the term of this patent is extended or adjusted under 35 U.S.C. 154(b) by 915 days.

(21) Appl. No.: 10/916,684

(22) Filed: Aug. 11, 2004

(65) Prior Publication Data

US 2006/0035755 A1 Feb. 16, 2006

(51) Int. Cl.
*A63B 22/04* (2006.01)
*A63B 22/12* (2006.01)

(52) U.S. Cl. ..... 482/52; 482/62

(58) Field of Classification Search ..... 482/51–54, 482/57, 62, 70, 71, 121, 123, 129, 130, 142; *A63B 22/04, A63B 12/00*

See application file for complete search history.

(56) References Cited

U.S. PATENT DOCUMENTS

| | | | | |
|---|---|---|---|---|
| 3,316,898 A | | 5/1967 | Brown | |
| 3,501,140 A | * | 3/1970 | Eichorn | 482/130 |
| 3,756,595 A | | 9/1973 | Hague | |
| 3,824,994 A | | 7/1974 | Soderberg, Sr. | |
| 3,941,377 A | | 3/1976 | Lie | |
| 4,140,312 A | * | 2/1979 | Buchmann | 482/62 |
| 4,300,760 A | | 11/1981 | Bobroff | |
| 4,354,675 A | | 10/1982 | Barclay | |
| 4,625,962 A | | 12/1986 | Street | |
| 4,679,787 A | * | 7/1987 | Guilbault | 482/54 |
| 4,708,338 A | | 11/1987 | Potts | |
| 4,720,093 A | | 1/1988 | Del Mar | |
| 4,938,474 A | | 7/1990 | Sweeney et al. | |
| 5,013,031 A | | 5/1991 | Bull | |
| 5,039,088 A | | 8/1991 | Shifferaw | |
| 5,078,389 A | | 1/1992 | Chen | |

(Continued)

FOREIGN PATENT DOCUMENTS

CN 2169450 6/1994

(Continued)

OTHER PUBLICATIONS

Horizon Series E30 E20 [online] [ retrieved on Jul. 27, 2004] Retrieved from the Internet: URL: http://www.horizonfitness.com/horizon-series/ellipticals/e20.php.

(Continued)

*Primary Examiner*—Loan H Thanh
*Assistant Examiner*—Oren Ginsberg
(74) *Attorney, Agent, or Firm*—Workman Nydegger

(57) ABSTRACT

A combined anaerobic and aerobic exercise system comprises a multi-part frame, for example a telescoping frame, or a pivoting frame. The aerobic system may include an elliptical exercise device, while the anaerobic system may include a cable-based system wherein resistance is adjustable. An electronic console system at the exercise system allows a user to view progress in both anaerobic and aerobic workouts, and to send input signals that adjust anaerobic and aerobic resistance mechanisms.

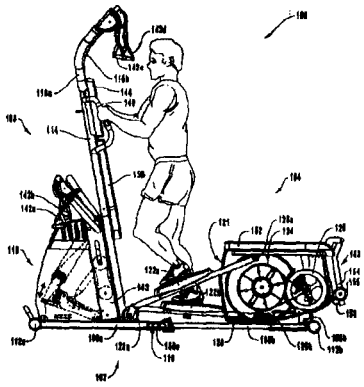

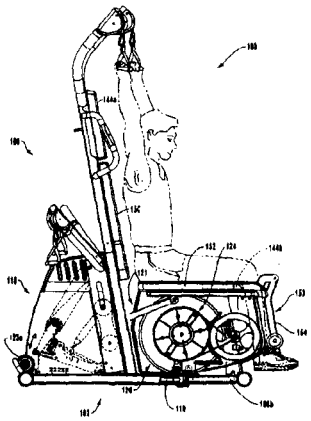

29 Claims, 14 Drawing Sheets